US012006934B2

(12) United States Patent
Iwamoto et al.

(10) Patent No.: US 12,006,934 B2
(45) Date of Patent: Jun. 11, 2024

(54) SCROLL COMPRESSOR AND REFRIGERATION CYCLE APPARATUS

(71) Applicant: Mitsubishi Electric Corporation, Tokyo (JP)

(72) Inventors: Yutaro Iwamoto, Tokyo (JP); Kohei Tatsuwaki, Tokyo (JP); Tomokazu Matsui, Tokyo (JP); Koji Masumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/006,194

(22) PCT Filed: Oct. 1, 2020

(86) PCT No.: PCT/JP2020/037421
§ 371 (c)(1),
(2) Date: Jan. 20, 2023

(87) PCT Pub. No.: WO2022/070382
PCT Pub. Date: Apr. 7, 2022

(65) Prior Publication Data
US 2023/0258178 A1 Aug. 17, 2023

(51) Int. Cl.
*F04C 18/02* (2006.01)
*F04B 39/10* (2006.01)
*F04C 29/12* (2006.01)

(52) U.S. Cl.
CPC ..... *F04C 18/0215* (2013.01); *F04B 39/1086* (2013.01); *F04C 29/12* (2013.01); *F04C 29/128* (2013.01); *F04C 2250/102* (2013.01)

(58) Field of Classification Search
CPC .... F04C 18/0215; F04C 29/12; F04C 29/128; F04C 2250/102; F04B 39/1086
See application file for complete search history.

(56) References Cited

U.S. PATENT DOCUMENTS 9,188,117 B2 * 11/2015 Ito ..... F04B 39/1086
2013/0078126 A1 3/2013 Kurita et al.
2018/0363649 A1 12/2018 Tatsuwaki et al.

FOREIGN PATENT DOCUMENTS

CN 209856036 U * 12/2019 ..... F04C 18/0207
JP 2003-120563 A 4/2003
(Continued)

OTHER PUBLICATIONS

Foreign Patent Publication and Machine Translation for CN 207795587U, Inventor Zhao, Title: Compressor, Published Aug. 31, 2018. (Year: 2018).*

(Continued)

*Primary Examiner* — Mary Davis
(74) *Attorney, Agent, or Firm* — Posz Law Group, PLC

(57) ABSTRACT

A scroll compressor includes: a shell; a compression mechanism unit accommodated in the shell and defining a compression chamber, the compression mechanism unit having a discharge port through which a discharge chamber and the compression chamber communicate with one another; a discharge valve mechanism that opens and closes the discharge port. The discharge valve mechanism includes a valve seat provided on an outlet portion of the discharge port and a valve and closes the valve seat when sitting on the valve seat. The valve seat includes an annular portion serving as an edge of an opening of the outlet portion and a valve supporting portion that is provided in a region surrounded by the inner circumference of the annular portion and divides the opening of the outlet portion into plural valve seat holes. The valve is in contact with at least a portion of the valve supporting portion and with the annular portion, when sitting on the valve seat.

15 Claims, 12 Drawing Sheets

(56) References Cited

FOREIGN PATENT DOCUMENTS

| | | | |
|---|---|---|---|
| JP | 2004-360644 | A | 12/2004 |
| JP | 2013-072345 | A | 4/2013 |
| WO | 2017/138131 | A1 | 8/2017 |

OTHER PUBLICATIONS

International Search Report of the International Searching Authority mailed Dec. 8, 2020 in corresponding International Application No. PCT/JP2020/037421 (and English translation).

* cited by examiner

Comparative Example

Comparative Example

SCROLL COMPRESSOR AND REFRIGERATION CYCLE APPARATUS

CROSS REFERENCE TO RELATED APPLICATION

This application is a U.S. national stage application of PCT/JP2020/037421 filed on Oct. 1, 2020, the contents of which are incorporated herein by reference.

TECHNICAL FIELD

The present disclosure relates to a scroll compressor and a refrigeration cycle apparatus including the compressor. In particular, the present disclosure relates to the structure of a discharge port of a compression mechanism unit.

BACKGROUND ART

Scroll compressors include a discharge chamber in which the refrigerant compressed in a compression mechanism unit is accommodated. The compression mechanism unit has a discharge port enabling a compression chamber and the discharge chamber to communicate with one another for the purpose of discharging the refrigerant that has been compressed in the compression chamber, into the discharge chamber. The compression mechanism unit includes a fixed scroll. A discharge valve mechanism that opens and closes the discharge port is provided on a portion of the fixed scroll on the discharge chamber side (for example, refer to Patent Literature 1). The discharge valve mechanism functions as a partition between a high-pressure space on the discharge chamber side and a low-pressure space on the compression mechanism unit side. The pressure inside the low-pressure space is maintained low before refrigerant is compressed by using the fixed scroll.

CITATION LIST

Patent Literature

Patent Literature 1: Japanese Unexamined Patent Application Publication No. 2003-120563

SUMMARY OF INVENTION

Technical Problem

The discharge valve mechanism of such a known scroll compressor includes a plate-shaped valve that opens and closes the discharge port and a valve seat. The valve seat is provided around the discharge port, and the valve sits on the valve seat. The valve sits only on the valve seat, and a portion, of the valve, to cover the discharge port does not sit on any portion, thereby not being supported. Thus, the portion of the valve is deformed, that is, bent so as to be recessed inside the discharge port under the load generated when the discharge port is opened and closed. In particular, under the condition of a high-speed operation or a high compression ratio operation of the scroll compressor, the load applied to the valve is increased, and the amount of bending of the portion of the valve that covers the discharge port is also increased. Thus, the reliability of the valve is decreased.

The present disclosure has been made to solve such an above-described problem and provides a scroll compressor and a refrigeration cycle apparatus that enable minimization of the amount of bending of a valve.

Solution to Problem

A scroll compressor according to one embodiment of the present disclosure includes: a shell defining the outline of a sealed container; a compression mechanism unit accommodated in the shell and defining a compression chamber in which refrigerant is compressed, the compression mechanism unit having a discharge port that is a through hole through which a discharge chamber surrounded by the shell and the compression mechanism unit and the compression chamber communicate with one another; a discharge valve mechanism that is provided on a portion, of the compression mechanism unit, facing the discharge chamber and opens and closes the discharge port. The discharge valve mechanism includes a valve seat provided on an outlet portion of the discharge port that is an outlet-side opening end for refrigerant and a valve that has a plate shape and closes the valve seat when sitting on the valve seat. The valve seat includes an annular portion serving as an edge of an opening of the outlet portion and a valve supporting portion that is provided in a region surrounded by the inner circumference of the annular portion and divides the opening of the outlet portion into plural valve seat holes that are through holes. The valve is in contact with at least a portion of the valve supporting portion and with the annular portion, when sitting on the valve seat.

A refrigeration cycle apparatus according to another embodiment of the present disclosure includes the scroll compressor.

Advantageous Effects of Invention

According to the scroll compressor and the refrigeration cycle apparatus of the embodiments of the present disclosure, the valve seat of the scroll compressor includes the annular portion serving as the edge of the opening of the outlet portion and the valve supporting portion that is provided in a region surrounded by the inner circumference of the annular portion and divides the opening of the outlet portion into the plural valve seat holes. When sitting on the valve seat, the valve is in contact with at least a portion of the valve supporting portion provided inside the discharge port and with the annular portion. The valve is in contact with the valve seat at plural spots including a spot at which the valve faces the edge portion of the outlet portion, and the amount of bending of the valve can thereby be dispersed. Thus, the amount of bending of the valve due to the load exerted at the time of valve sitting can be minimized.

DESCRIPTION OF EMBODIMENTS

Figure 1:
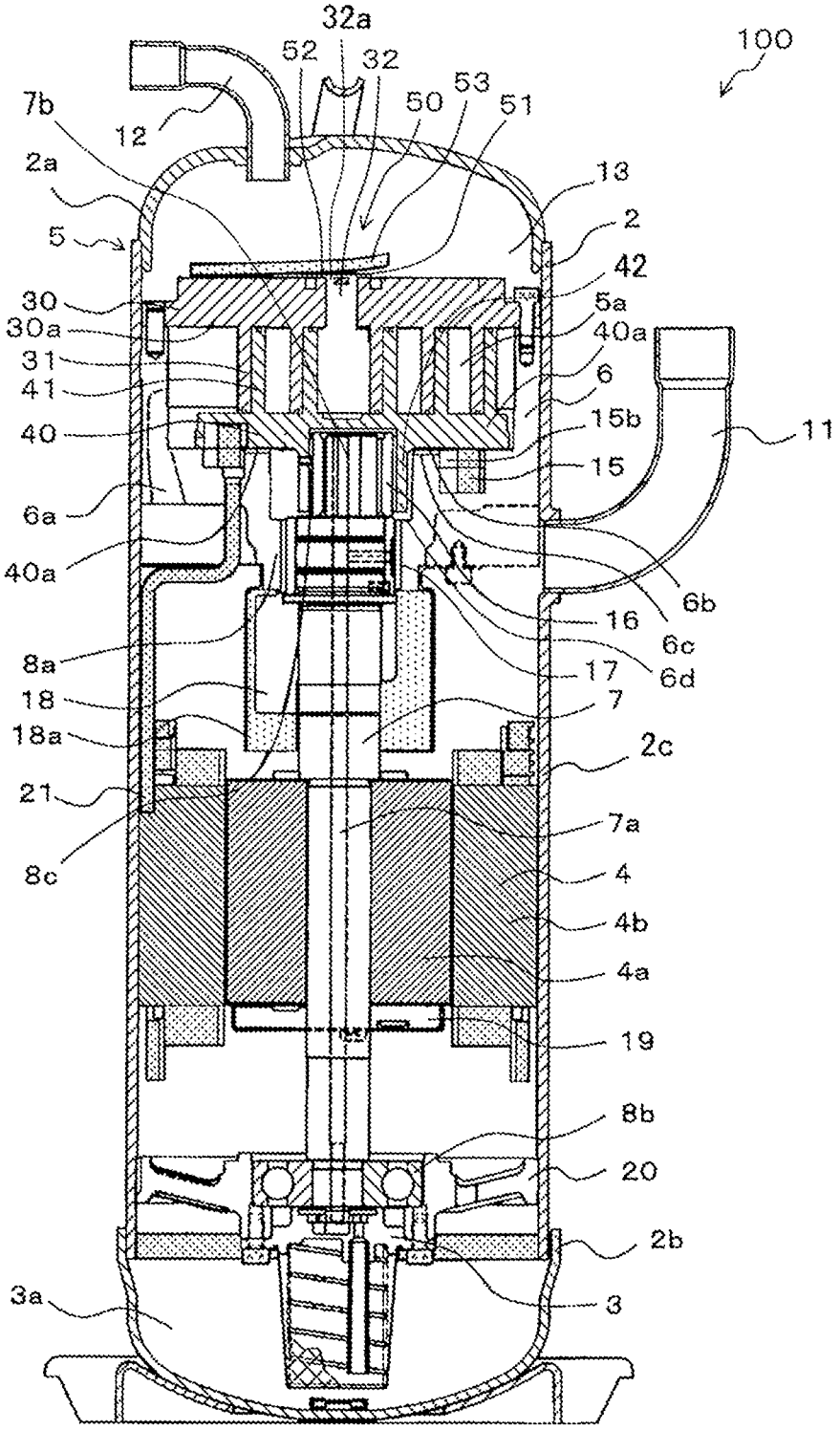
FIG. 1 is a schematic sectional view of a scroll compressor according to Embodiment 1.

Hereinafter, scroll compressors and a refrigeration cycle apparatus according to embodiments will be described with reference to the drawings. Parts denoted by the same references in the following drawings are the same or equivalent to one another, and the same applies throughout the entire description of the embodiments below.

The forms of the constituents represented in the entire description are merely examples, and the forms of the constituents are not limited to those in the description. In the drawings, the relationship of the sizes of constituting parts sometimes differs from the relationship of the sizes of actual constituting parts. Although the terms representing directions (such as "upper/above", "lower/below", "right", "left", "front", and "rear") are appropriately used for facilitating understanding, such representation and terms are used for an illustration purpose and do not limit the arrangement and the orientation of the apparatus or the components.

Embodiment 1

<Configuration of Scroll Compressor 100>

FIG. 1 is a schematic sectional view of a scroll compressor 100 according to Embodiment 1. The scroll compressor 100 is applied to a refrigeration cycle apparatus 200 (described later), used for refrigeration or air-conditioning, such as a refrigerator or a freezer, a vending machine, an air-conditioning apparatus, a refrigeration apparatus, or a water heater. The scroll compressor 100 sucks the refrigerant circulating through a refrigeration circuit of the refrigeration cycle apparatus 200, compresses and brings the refrigerant into a high-temperature and high-pressure state, and discharges the refrigerant in such a state.

As FIG. 1 illustrates, the scroll compressor 100 includes a shell 2, an oil pump 3, a motor 4, a compression mechanism unit 5, a frame 6, and a shaft portion 7. The scroll compressor 100 further includes a suction pipe 11, a discharge pipe 12, a discharge chamber 13, an Oldham ring 15, a slider 16, a sleeve 17, a first balancer 18, a second balancer 19, a sub-frame 20, and an oil drain pipe 21.

(Shell 2)

The shell 2 defines the outline of a sealed container and forms a sealed space inside the shell 2. The shell 2 has a bottomed hollow cylindrical shape and has an inner bottom portion serving as an oil sump 3*a* for storing a lubricating oil. The shell 2 includes a middle shell 2*c* constituting a circumferential wall of the hollow cylindrical shape, an upper shell 2*a* having a dome shape and closing an upper opening of the middle shell 2*c*, and a lower shell 2*b* having a dome shape and closing a lower opening of the middle shell 2*c*.

The oil pump 3, the motor 4, the compression mechanism unit 5, the frame 6, the shaft portion 7, the sub-frame 20, and the oil drain pipe 21, for example, are accommodated inside the shell 2.

(Oil Pump 3)

The oil pump 3 is accommodated in the shell 2 and sucks up oil from the oil sump 3*a*. The oil pump 3 is provided in a lower region inside the shell 2. For lubrication, the oil pump 3 supplies the oil sucked up from the oil sump 3*a* to a part to be lubricated such as a bearing portion inside the scroll compressor 100.

For example, the oil that has been sucked up by the oil pump 3 and has been used to lubricate an orbiting bearing 8*c* is stored in an inner space 6*d* of the frame 6, then passes through an oil supply groove 6*c* radially provided in a thrust bearing 6*b*, flows into an Oldham ring space 15*b*, and lubricates the Oldham ring 15. The oil drain pipe 21 is connected to the Oldham ring space 15*b*, and the oil is returned to the oil sump 3*a* through the oil drain pipe 21.

(Motor 4)

The motor 4 is installed, inside the shell 2, between the frame 6 and the sub-frame 20 and rotates the shaft portion 7. The motor 4 includes a rotor 4*a* and a stator 4*b*. The rotor 4*a* is provided in a region surrounded by the inner circumference of the stator 4*b* and is mounted on the shaft portion 7. The rotor 4*a* rotates the shaft portion 7 by being rotated on the axis of the rotor 4*a*. The stator 4*b* rotates the rotor 4*a* by being supplied with electric power from an inverter (not illustrated).

(Compression Mechanism Unit 5)

The compression mechanism unit 5 is disposed inside the shell 2 and compresses fluid (such as refrigerant) that is sucked inside the shell 2 through the suction pipe 11. The compression mechanism unit 5 is accommodated in the shell 2 and defines a compression chamber 5*a* in which refrigerant is compressed. The compression mechanism unit 5 has a discharge port 32 through which the refrigerant that has been compressed in the compression chamber 5*a* is discharged. The compression mechanism unit 5 includes a fixed scroll 30 fixed to the shell 2 and an orbiting scroll 40 that orbits (that is, revolves) relative to the fixed scroll 30. In the compression mechanism unit 5, the compression chamber 5*a* is defined by the fixed scroll 30 and the orbiting scroll 40.

For example, by a bolt or other tools, the fixed scroll 30 is fixed to the frame 6 that is fixed to, supported by, and positioned inside the shell 2. The fixed scroll 30 is disposed so as to face the orbiting scroll 40. The fixed scroll 30 includes a base plate 30*a* and a spiral portion 31 extending downward from a lower surface of the base plate 30*a*.

The spiral portion 31 is a protrusion protruding toward the orbiting scroll 40 from a wall surface, of the base plate 30*a*, facing the orbiting scroll 40. A section of the protrusion parallel to the base plate 30*a* has a spiral shape. The base plate 30*a* has a plate shape. A central portion of the base plate 30*a* constituting the fixed scroll 30 has the discharge port 32 through which the refrigerant compressed in the compression chamber 5*a* is discharged. The discharge port 32 passes through the base plate 30*a*.

The discharge port 32 is a through hole through which the discharge chamber 13 and the compression chamber 5*a* communicate with one another.

A discharge valve mechanism 50 is provided on an outlet portion 32*a* that is a refrigerant outlet-side opening end in the discharge port 32 formed in the fixed scroll 30.

The discharge valve mechanism 50 prevents the refrigerant discharged from the outlet portion 32*a* of the discharge port 32, from flowing backward. Note that the details of the discharge valve mechanism 50 will be described later.

The orbiting scroll 40 performs a revolving motion, that is, an orbital motion relative to the fixed scroll 30, and the Oldham ring 15 prevents the orbiting scroll 40 from rotating on the axis of the orbiting scroll 40. The orbiting scroll 40 includes a base plate 40*a* and a spiral portion 41 extending upward from an upper surface of the base plate 40*a*.

The spiral portion 41 is a protrusion protruding toward the fixed scroll 30 from a wall surface, of the base plate 40*a*, facing the fixed scroll 30. A section of the protrusion parallel to the base plate 40*a* has a spiral shape. The base plate 40*a* has a disk shape and performs an orbital motion inside the frame 6 in response to the rotation of the shaft portion 7.

The fixed scroll 30 and the orbiting scroll 40 are arranged so that, at the surfaces of the fixed scroll 30 and the orbiting scroll 40 that face one another, the spiral portion 31 and the spiral portion 41 face one another and mesh with one another. A space formed by the spiral portion 31 of the fixed scroll 30 and the spiral portion 41 of the orbiting scroll 40 meshing with one another serves as the compression chamber 5*a*. The compression chamber 5*a* is a space surrounded by the base plate 40*a* and the spiral portion 41 of the orbiting scroll 40 and the base plate 30*a* and the spiral portion 31 of the fixed scroll 30. When the shaft portion 7 causes the orbiting scroll 40 to perform an orbital motion, refrigerant in a gaseous state is compressed in the compression chamber 5*a*.

(Frame 6)

The frame 6 has a tubular shape and includes an outer circumferential portion fixed to the shell 2. Inside an inner circumferential portion of the frame 6, the compression mechanism unit 5 is accommodated. The frame 6 holds the orbiting scroll 40 of the compression mechanism unit 5. The frame 6 supports, with a main bearing 8*a* therebetween, the shaft portion 7 so that the shaft portion 7 can rotate. The frame 6 has a suction port 6*a*. The gaseous refrigerant inside the shell 2 flows into the compression mechanism unit 5 through the suction port 6*a*.

(Shaft Portion 7)

The shaft portion 7 is connected to the motor 4 and to the orbiting scroll 40 and transmits a rotational force of the motor 4 to the orbiting scroll 40. The shaft portion 7 is supported in a rotating manner by the main bearing 8*a* provided on the frame 6 and by a sub-bearing 8*b* provided on the sub-frame 20 (described later). The shaft portion 7 has, thereinside, an oil passage 7*a* through which the oil sucked up by the oil pump 3 flows upward. The shaft portion 7 has, in an upper portion thereof, an eccentric portion 7*b* whose central axis is eccentrically provided.

(Suction Pipe 11)

The suction pipe 11 is a pipe through which gaseous refrigerant is sucked inside the shell 2. The suction pipe 11 is provided on a side wall portion of the shell 2 and connected to the middle shell 2*c*.

(Discharge Pipe 12)

The discharge pipe 12 is a pipe through which the refrigerant that has been compressed in the compression mechanism unit 5 is discharged outside the shell 2. The discharge pipe 12 is provided on an upper portion of the shell 2 and connected to the upper shell 2*a*.

(Discharge Chamber 13)

The discharge chamber 13 is a space provided above the compression mechanism unit 5 and surrounded by the upper shell 2*a* of the shell 2 and the compression mechanism unit 5. The refrigerant that has been compressed by the compression mechanism unit 5 and has been discharged from the compression mechanism unit 5 is accommodated in the discharge chamber 13.

(Oldham Ring 15)

The Oldham ring 15 is mounted on a thrust surface, of the orbiting scroll 40, on the opposite side from the upper surface on which the spiral portion 41 is formed. The Oldham ring 15 prevents the orbiting scroll 40 from rotating on the axis of the orbiting scroll 40. While preventing the orbiting scroll 40 from rotating on the axis of the orbiting scroll 40, the Oldham ring 15 enables the orbiting scroll 40 to perform an orbital motion. An Upper surface and a lower surface of the Oldham ring 15 have respective claws (not illustrated) that protrude orthogonally to one another. The claws of the Oldham ring 15 are fitted in respective Oldham grooves (not illustrated) formed in the orbiting scroll 40 and in the frame 6.

(Slider 16)

The slider 16 has a tubular shape and is mounted on an outer circumferential surface of an upper portion of the shaft portion 7. The slider 16 is at a position at which the slider 16 faces an inner surface of a boss portion 42 having a tubular shape and provided in a lower portion of the orbiting scroll 40. The orbiting scroll 40 is mounted on the shaft portion 7 with the slider 16 interposed therebetween. Thus, the orbiting scroll 40 rotates in response to the rotation of the shaft portion 7. Note that the orbiting bearing 8*c* serving as a bearing is provided between the orbiting scroll 40 and the slider 16.

(Sleeve 17)

The sleeve 17 has a tubular shape and is provided between the frame 6 and the main bearing 8*a*. The sleeve 17 suppresses the frame 6 and the shaft portion 7 from tilting relative to one another.

(First Balancer 18)

The first balancer 18 is mounted on the shaft portion 7. The first balancer 18 is disposed between the frame 6 and the rotor 4*a*. The first balancer 18 corrects the imbalance caused by the orbiting scroll 40 and the slider 16. Note that the first balancer 18 is accommodated in a balancer cover 18*a*.

(Second Balancer 19)

The second balancer 19 is mounted on the shaft portion 7. The second balancer 19 is disposed between the rotor 4*a* and the sub-frame 20 and mounted on a lower surface of the rotor 4*a*. The second balancer 19 corrects the imbalance caused by the orbiting scroll 40 and the slider 16.

(Sub-Frame 20)

The sub-frame 20 is provided, inside the shell 2, below the motor 4 and supports the shaft portion 7 with the sub-bearing 8*b* therebetween so that the shaft portion 7 can rotate.

(Oil Drain Pipe 21)

The oil drain pipe 21 is a pipe connecting the space between the frame 6 and the orbiting scroll 40 and the space between the frame 6 and the sub-frame 20 to one another. Through the oil drain pipe 21, the excess portion of the oil flowing in the space between the frame 6 and the orbiting scroll 40 flows into the space between the frame 6 and the sub-frame 20. The oil that has flowed into the space between the frame 6 and the sub-frame 20 passes through the sub-frame 20 and is returned to the oil sump 3*a*.

<Operation of Scroll Compressor 100>

When the stator 4*b* is supplied with electric power, the rotor 4*a* produces torque and rotates the shaft portion 7 supported by the main bearing 8*a* of the frame 6 and by the sub-bearing 8*b*. In the orbiting scroll 40, the boss portion 42 is driven by the eccentric portion 7*b* of the shaft portion 7. The orbiting scroll 40 is prevented by the Oldham ring 15 from rotating on the axis of the orbiting scroll 40 and performs a revolving motion. That is, the orbiting scroll 40 performs an orbital motion by the boss portion 42 of the orbiting scroll 40 being driven by the eccentric portion 7*b* of the shaft portion 7 while the orbiting scroll 40 is prevented from rotating on the axis of the orbiting scroll 40 by the Oldham ring 15 that performs a reciprocating motion in a direction parallel to the Oldham groove of the frame 6. This motion under the above-described condition changes the capacity of the compression chamber 5*a* formed by combining the spiral portion 31 of the fixed scroll 30 and the spiral portion 41 of the orbiting scroll 40.

With the orbital motion of the orbiting scroll 40, the gaseous refrigerant is sucked into the shell 2 through the suction pipe 11, flows into the compression chamber 5*a* formed between the spiral portion 31 of the fixed scroll 30 and the spiral portion 41 of the orbiting scroll 40, and is compressed while approaching the center. The compressed refrigerant opens the valve of the discharge valve mechanism 50 and is discharged from the discharge port 32 formed in the fixed scroll 30, and, through the discharge pipe 12, the refrigerant is delivered outside the scroll compressor 100, that is, delivered into a refrigerant circuit.

Note that, in the scroll compressor 100, the first balancer 18 mounted on the shaft portion 7 and the second balancer 19 mounted on the rotor 4*a* correct the imbalance caused during the motions of the orbiting scroll 40 and the Oldham ring 15. In addition, the lubricating oil stored in a lower portion of the shell 2 is supplied, through the oil passage 7*a* inside the shaft portion 7, to sliding portions such as the main bearing 8*a*, the sub-bearing 8*b*, and the thrust surface.

<Configuration of Discharge Valve Mechanism 50>

Figure 2:
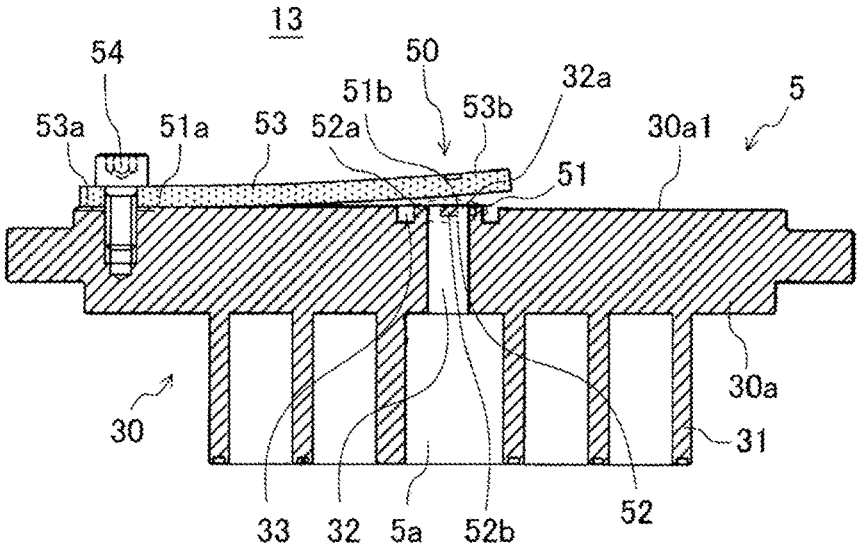
FIG. 2 is a schematic sectional view of a discharge valve mechanism of the scroll compressor according to Embodiment 1.

FIG. 2 is a schematic sectional view of the discharge valve mechanism 50 of the scroll compressor 100 according to Embodiment 1. The discharge valve mechanism 50 will be described with reference to FIG. 1 and FIG. 2. The discharge valve mechanism 50 is provided on a portion, of the compression mechanism unit 5, facing the discharge chamber 13 and has a function of opening and closing the discharge port 32. More specifically, as FIG. 2 illustrates, the discharge valve mechanism 50 is provided on a portion, of the fixed scroll 30, on the discharge chamber 13 side. In the fixed scroll 30, a surface, on the discharge chamber 13 side, on which the discharge valve mechanism 50 is provided is flat.

As FIG. 2 illustrates, the discharge valve mechanism 50 includes one reed valve 51 and a valve seat 52 on which the reed valve 51 sits. The discharge valve mechanism 50 further includes a valve retainer 53.

(Reed Valve 51)

The reed valve 51 opens and closes the outlet portion 32*a* of the discharge port 32 depending on the discharge pressure of refrigerant. The reed valve 51 is provided on a portion, of the compression mechanism unit 5, on the discharge chamber 13 side and is disposed so as to cover the outlet portion 32*a* that is the outlet-side opening end of the discharge port 32.

The reed valve 51 has a long plate shape. The reed valve 51 has a fixed portion 51*a* mounted on the fixed scroll 30 of the compression mechanism unit 5 and a distal end portion 51*b* that is a free end. The reed valve 51 extends straight from the fixed portion 51*a* to the distal end portion 51*b* in the longitudinal direction. Note that "straight" may be substantially "straight" without being limited to strictly "straight".

In the longitudinal direction of the reed valve 51, the fixed portion 51*a* positioned in an end portion on one side is mounted, together with the valve retainer 53, on the fixed scroll 30 by a fixing tool 54. The fixing tool 54 is, for example, a screw. The fixed portion 51*a* of the reed valve 51 is fixed to a surface portion 30*a*1, on the discharge chamber 13 side, of the base plate 30*a* constituting the fixed scroll 30.

In the longitudinal direction of the reed valve 51, the distal end portion 51*b* positioned in an end portion on the other side, that is, positioned at a distal end of the reed valve 51 extending from the fixed portion 51*a* in the longitudinal direction. The distal end portion 51*b* is a free end portion that is not fixed to any other part. The distal end portion 51*b* of the reed valve 51 sits on the valve seat 52 and covers the discharge port 32. The distal end portion 51*b* serves as a seal portion separating the space on the discharge chamber 13 side and the space on the compression chamber 5*a* side from one another. The reed valve 51 closes the valve seat 52 when the distal end portion 51*b* sits on the valve seat 52. When sitting on the valve seat 52, the reed valve 51 is in contact with at least a portion of a valve supporting portion 52*b* and with an annular portion 52*a* (described later).

(Valve Seat 52)

Figure 3:
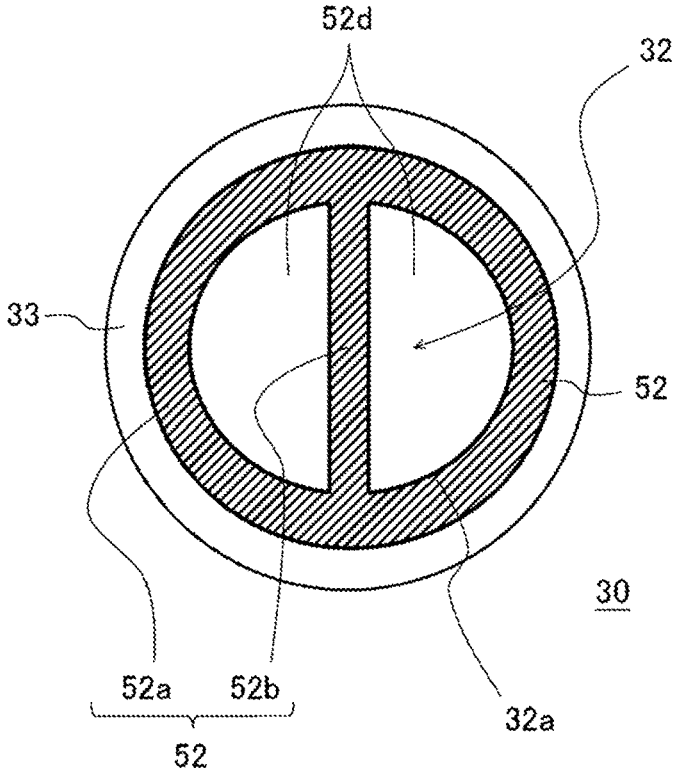
FIG. 3 is an enlarged top view conceptually illustrating a region including a valve seat of the scroll compressor according to Embodiment 1.

FIG. 3 is an enlarged top view conceptually illustrating a region including the valve seat 52 of the scroll compressor 100 according to Embodiment 1. The valve seat 52 receives the reed valve 51 that is a valve body, when the discharge port 32 is closed. The valve seat 52 is provided on a surface, of the fixed scroll 30, on the discharge chamber 13 side and provided at the outlet portion 32*a* of the discharge port 32 that is the outlet-side opening end for refrigerant.

As FIG. 2 and FIG. 3 illustrate, the valve seat 52 includes the annular portion 52*a* serving as the edge of the opening of the outlet portion 32*a* and the valve supporting portion 52*b* that is provided in a region surrounded by the inner circumference of the annular portion 52*a* and divides the opening of the outlet portion 32*a* into plural valve seat holes 52*d* that are through holes. The surfaces, of the annular portion 52*a* and the valve supporting portion 52*b*, on the discharge chamber 13 side are flush with on another, but such a configuration is not the only option.

The annular portion 52*a* is a circular annular wall portion when viewed, in plan, in the axial direction of the shaft portion 7 in FIG. 1, and the annular portion 52*a* has a hollow cylindrical shape. A groove 33 is formed beside the outer circumferential side of the annular portion 52*a*. The groove 33 has a circular annular shape when viewed, in plan, in the axial direction of the shaft portion 7, and the groove 33 is a portion, of the surface portion 30*a*1 of the fixed scroll 30, recessed toward the compression chamber 5*a*. Note that the annular portion 52*a* may be any wall portion having an annular shape when viewed, in plan, in the axial direction of the shaft portion 7 in FIG. 1 and is not limited to such a circular annular shape.

The valve supporting portion 52*b* has a rod shape so as to serve as a bridge between inner wall portions, of the annular portion 52*a*, facing one another. The valve supporting portion 52*b* has an "I" shape when viewed, in plan, in the axial direction of the shaft portion 7. When the reed valve 51 sits on the valve seat 52, at least a portion of the valve supporting portion 52*b* is in contact with the reed valve 51.

The valve supporting portion 52*b* extends orthogonally to the longitudinal direction of the reed valve 51. However, the valve supporting portion 52*b* may include any portion supporting the reed valve 51, near the center of the opening of the outlet portion 32*a*. Thus, the extending direction of the valve supporting portion 52*b* may be parallel to, or may intersect, the longitudinal direction of the reed valve 51. In addition, the valve supporting portion 52*b* may include any portion supporting the reed valve 51, inside the opening of the outlet portion 32*a*. Thus, such a portion supporting the reed valve 51 may be positioned, inside the opening of the outlet portion 32*a*, in a region other than the vicinity of the center of the opening.

The valve supporting portion 52*b* may be any part dividing the opening of the outlet portion 32*a* into the plural valve seat holes 52*d* formed inside the annular portion 52*a*. In addition, the valve supporting portion 52*b* may have any structure in which, when the reed valve 51 sits on the valve seat 52, at least a portion of the valve supporting portion 52*b* is in contact with the reed valve 51. Thus, the structure of the valve supporting portion 52*b* is not limited to the rod-shaped structure illustrated in FIG. 3.

As FIG. 3 illustrates, the valve seat 52 has two valve seat holes 52*d*. The valve seat holes 52*d* are defined by the valve seat 52 and formed in the outlet portion 32*a* that is the outlet-side opening end of the discharge port 32. The valve seat holes 52*d* are surrounded by the annular portion 52*a* and the valve supporting portion 52*b*. Each of the valve seat holes 52*d* is a through hole through which the refrigerant discharged from the discharge port 32 passes. The valve seat hole 52*d* has, for example, as FIG. 3 illustrates, a fan shape when viewed, in plan, in the axial direction of the shaft portion 7. The reed valve 51 sits on the valve seat 52 so as to close the valve seat holes 52*d*.

Note that the number of formed valve seat holes 52*d* is not limited to two. The valve seat 52 may have any number of valve seat holes 52*d* but at least two. In the discharge valve mechanism 50, the valve supporting portion 52*b* is provided so that two or more valve seat holes 52*d* are formed in the discharge port 32 that is opened at a central region, and the number of spots at which the reed valve 51 sits on the valve seat 52 is thereby increased.

Figure 4:
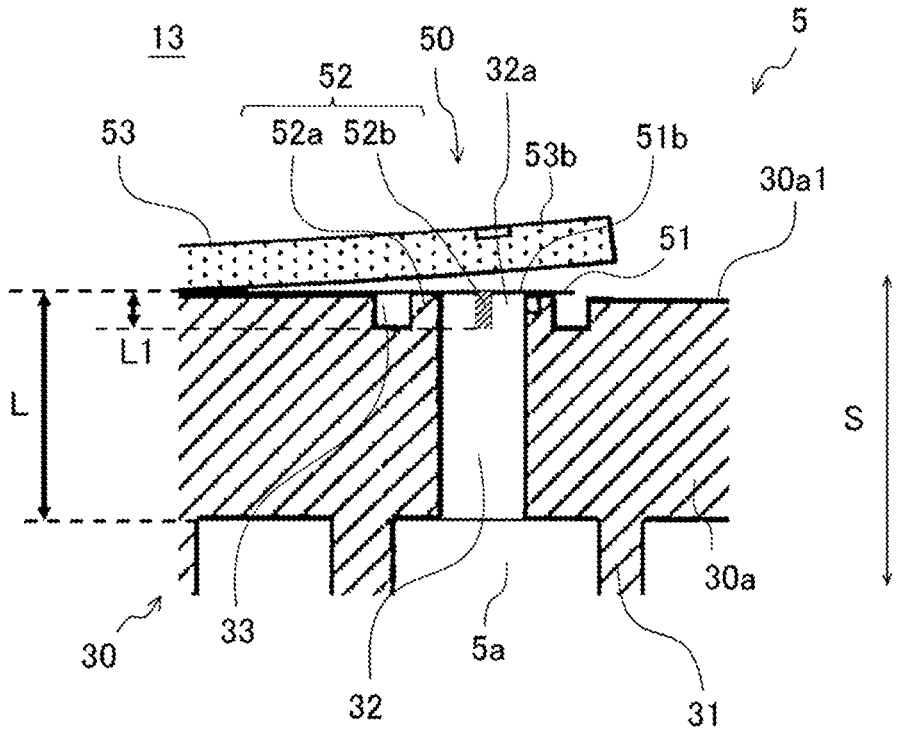
FIG. 4 is an enlarged view of the vicinity of an outlet portion of the discharge valve mechanism in FIG. 2.

FIG. 4 is an enlarged view of the vicinity of the outlet portion 32*a* of the discharge valve mechanism 50 in FIG. 2. As FIG. 4 illustrates, the valve supporting portion 52*b* does not necessarily extend throughout the thickness of the entire base plate 30*a* constituting the fixed scroll 30. Note that the thickness of the base plate 30*a* means the thickness of the base plate 30*a* in an axial direction S of the shaft portion 7 illustrated in FIG. 1. For example, a thickness L1 of the valve supporting portion 52*b* may be equal to one-fifteenth to one-fifth of a thickness L of the base plate 30*a*. A pressure loss is increased when the thickness L1 of the valve supporting portion 52*b* is large whereas reliability in supporting the reed valve 51 is decreased when the thickness L1 is small.

Figure 5:
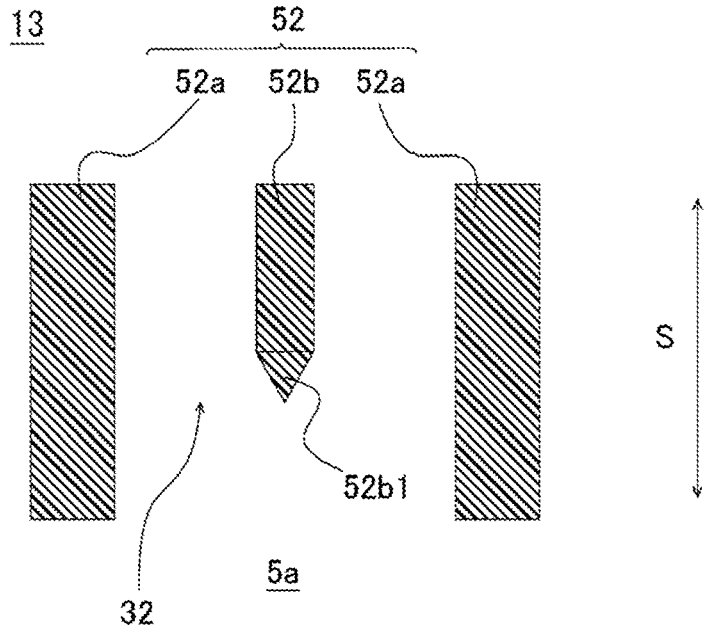
FIG. 5 is an enlarged view conceptually illustrating Modification 1 of a valve supporting portion according to Embodiment 1.

FIG. 5 is an enlarged view conceptually illustrating Modification 1 of the valve supporting portion 52*b* according to Embodiment 1. As FIG. 5 illustrates, the valve supporting portion 52*b* may include a support tip portion 52*b*1. The support tip portion 52*b*1 serves as a lower end portion of the valve supporting portion 52*b* and positioned on the compression chamber 5*a* side in the axial direction S of the shaft portion 7 in FIG. 1. As FIG. 5 illustrates, the support tip portion 52*b*1 may become sharper toward the space of the compression chamber 5*a*. For example, the valve supporting portion 52*b* includes the support tip portion 52*b*1 that is sharp pointed in a vertical section parallel to the axial direction S of the shaft portion 7, and the support tip portion 52*b*1 may have a triangular shape so as to have a peak of the projection. The pressure loss of the high-pressure gas flowing from the compression chamber 5*a* toward the discharge chamber 13 can be reduced by the valve supporting portion 52*b* including the support tip portion 52*b*1 that becomes sharper toward the space of the compression chamber 5*a*.

Figure 6:
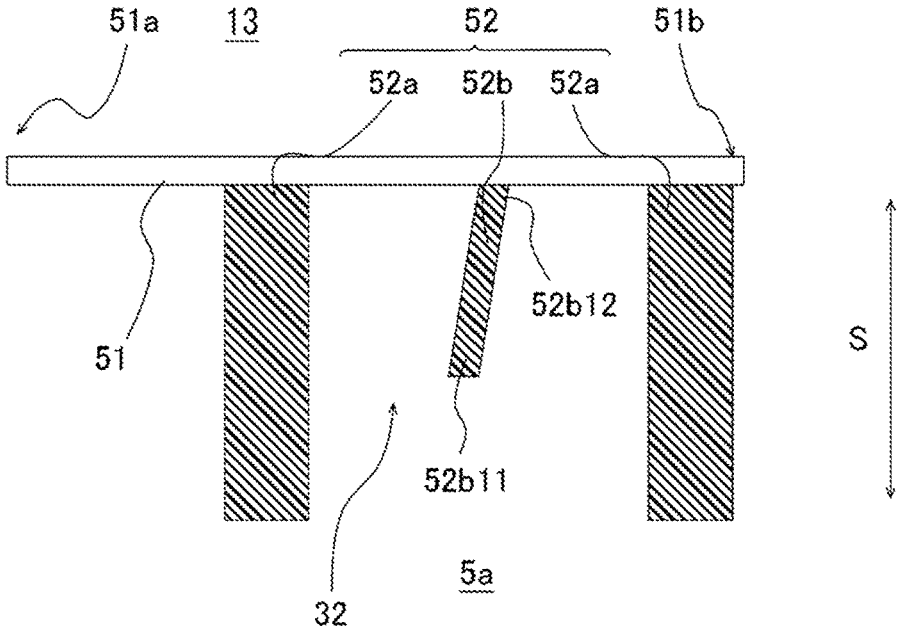
FIG. 6 is an enlarged view conceptually illustrating Modification 2 of the valve supporting portion according to Embodiment 1.

FIG. 6 is an enlarged view conceptually illustrating Modification 2 of the valve supporting portion 52*b* according to Embodiment 1. As FIG. 6 illustrates, the valve supporting portion 52*b* may be provided at an angle so that a greater portion of the gas flowing from the compression chamber 5*a* toward the discharge chamber 13 flows toward the distal end portion 51*b* of the reed valve 51, and the valve supporting portion 52*b* may thus facilitate opening the reed valve 51. For example, the valve supporting portion 52*b* may be tilted so that an upper end portion 52*b*12 is closer, than a lower end portion 52*b*11, to the distal end portion 51*b* of the reed valve 51 in top view. Note that, in the valve supporting portion 52*b*, the upper end portion 52*b*12 is an end portion on the discharge chamber 13 side, and the lower end portion 52*b*11 is an end portion on the compression chamber 5*a* side. The valve supporting portion 52*b* is tilted relative to the direction in which a flow passage of the discharge port 32 runs.

(Valve Retainer 53)

As FIG. 2 illustrates, the valve retainer 53 is a long plate-shaped part thicker than the reed valve 51 and includes a fixed end portion 53*a* mounted on the compression mechanism unit 5 and a distal end portion 53*b* that is a free end. The valve retainer 53 extends from the fixed end portion 53*a* to the distal end portion 53*b* in the longitudinal direction, and the distal end portion 53*b* is bent to the discharge chamber 13 side. By supporting the reed valve 51 from the back side when the reed valve 51 is opened, the valve retainer 53 protects the reed valve 51 for preventing the reed valve 51 from being excessively deformed.

<Description of Operation of Discharge Valve Mechanism 50>

The discharge valve mechanism 50 closes the discharge port 32 by the distal end portion 51*b* sitting on the valve seat 52. The distal end portion 51*b* sits on the valve seat 52 by the reed valve 51 being pushed against the valve seat 52 due to a difference in pressure between a high-pressure space on the discharge chamber 13 side and the compression chamber 5*a*. When sitting on the valve seat 52, the reed valve 51 closes the valve seat holes 52*d*. When the reed valve 51 sits on the valve seat 52, the discharge port 32 is in a valve closure state. The reed valve 51 regulates the flow of refrigerant from the compression chamber 5*a* side to the discharge chamber 13 side and prevents backflow of refrigerant from the discharge chamber 13, which is a high-pressure space, into the discharge port 32.

Inside the compression chamber 5*a*, the pressure increases as the compression of refrigerant progresses. When the pressure inside the compression chamber 5*a* becomes larger than the pressure on the discharge chamber 13 side, in the discharge valve mechanism 50, the reed valve 51 is bent backward by the distal end portion 51*b* of the reed valve 51 being pushed up, and the discharge port 32 is opened by the distal end portion 51*b* moving away from the valve seat 52. When the reed valve 51 is away from the valve seat 52, the discharge port 32 is in a valve open state. The reed valve 51 that has moved away from the valve seat 52 and has opened the discharge port 32 is supported by the valve retainer 53 from the back side for damage prevention. When the discharge of the high-pressure refrigerant inside the compression chamber 5*a* has been completed, the reed valve 51 returns to the original flat plate shape, and the discharge valve mechanism 50 turns in the valve closure state.

Advantageous Effects of Embodiment 1

Figure 7:
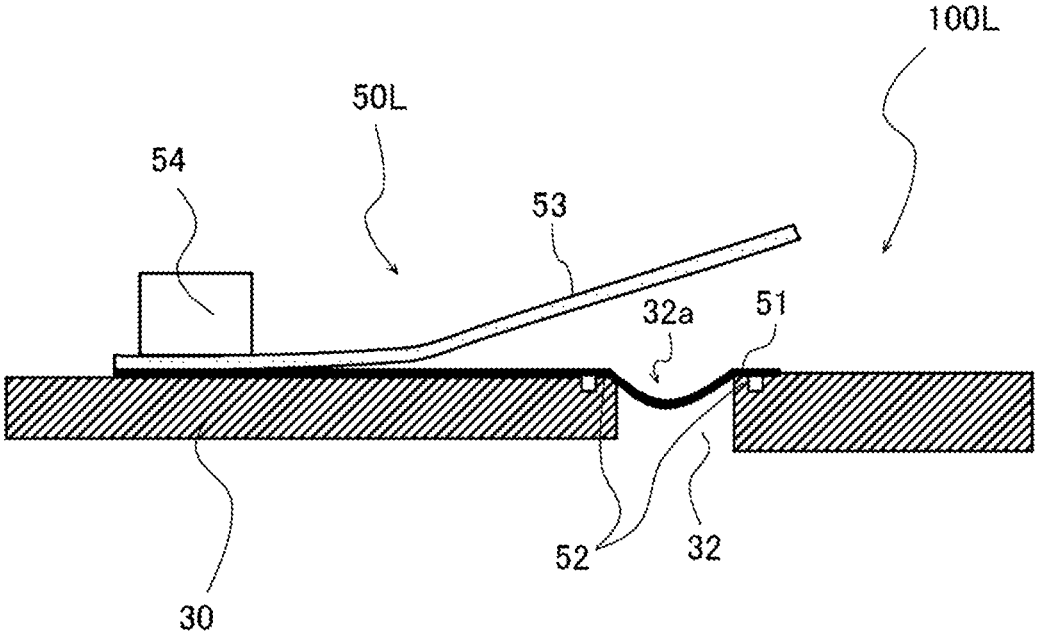
FIG. 7 is a schematic sectional view of a discharge valve mechanism of a scroll compressor according to a comparative example.

FIG. 7 is a schematic sectional view of a discharge valve mechanism 50L of a scroll compressor 100L according to a comparative example. The scroll compressor 100L according to the comparative example includes no valve supporting portion 52*b* in the valve seat 52. As FIG. 7 illustrates, in the scroll compressor 100L according to the comparative example, the reed valve 51 is bent inside the discharge port 32 when sitting on the valve seat 52.

Figure 8:
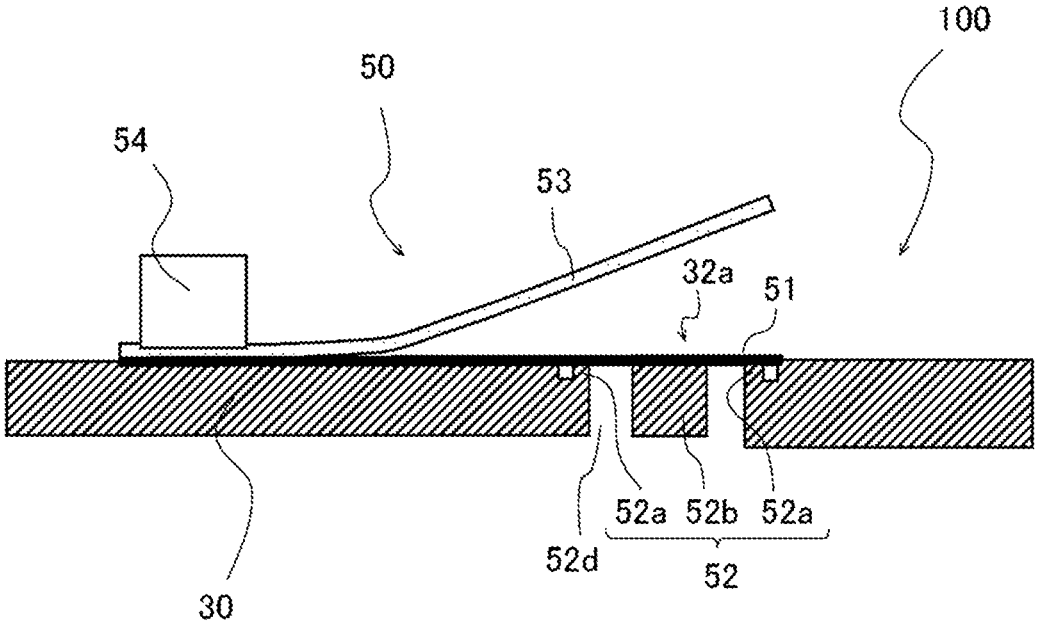
FIG. 8 is a schematic sectional view of the discharge valve mechanism of the scroll compressor according to Embodiment 1.

FIG. 8 is a schematic sectional view of the discharge valve mechanism 50 of the scroll compressor 100 according to Embodiment 1. The valve seat 52 of the scroll compressor 100 according Embodiment 1 includes the annular portion 52*a* serving as the edge of the opening of the outlet portion 32*a* and the valve supporting portion 52*b* that is provided in a region surrounded by the inner circumference of the annular portion 52*a* and divides the opening of the outlet portion 32*a* into the plural valve seat holes 52*d*. When sitting on the valve seat 52, the reed valve 51 is in contact with at least a portion of the valve supporting portion 52*b* provided inside the discharge port 32 and with the annular portion 52*a*.

The reed valve 51 is in contact with the valve seat 52 at plural spots including a spot at which the reed valve 51 faces the edge portion of the outlet portion 32*a*, and the amount of bending of the reed valve 51 can thereby be dispersed. Thus, the amount of bending of the reed valve 51 due to the load exerted at the time of sitting can be minimized. As a result, due to such minimization of the amount of bending of the reed valve 51, the reed valve 51 can be suppressed from being damaged by bending, and reliability of the strength of the reed valve 51 can be ensured. There is currently a demand for a further increase in the capacity of compressors. Thus, the refrigerant displacement of a scroll is increased, and the diameter of a discharge port is thereby required to be increased. The scroll compressor 100, according to Embodiment 1, having such an above-described structure enables an increase in the diameter of the discharge port.

The valve seat holes 52*d* of the valve seat 52 can be processed by, for example, casting, circular cutting, or forging. Thus, the valve seat 52 is easily produced.

According to Embodiment 1, the discharge valve mechanism 50 can support, with the valve supporting portion 52*b*, the reed valve 51 at a position at which the reed valve 51 is largely bent, unlike a structure in which the reed valve 51 sits on the valve seat 52 only at a spot at which the reed valve 51 faces the edge portion of the outlet portion 32*a*. Thus, with the scroll compressor 100, the width of the annular portion 52*a* of the valve seat 52 can be reduced without decreasing the reliability of the reed valve 51. The scroll compressor 100 having the above-described structure enables a reduction in the rupture resistance of an oil film between the reed valve 51 and the valve seat 52, and an over-compression loss at the timing of valve opening can thereby be reduced.

With the scroll compressor 100 including the valve supporting portion 52*b*, the annular portion 52*a* of the valve seat 52 does not contribute to an excessive increase in the sitting area of the valve seat 52, the oil-film rapture resistance between the reed valve 51 and the valve seat 52 when the valve is opened can be reduced, and an over-compression loss at the timing of valve opening can be reduced. In addition, with the scroll compressor 100 including the valve supporting portion 52*b*, the annular portion 52*a* of the valve seat 52 does not contribute to an excessive increase in the sitting area of the valve seat 52, and it is possible to minimize an increase in the amount of valve deformation of the reed valve 51 at the time of sitting and to minimize an increase in the stress generated at the reed valve 51.

For preventing a decrease in reliability of the strength of the reed valve 51, in the scroll compressor 100L according to the comparative example, it is conceivable to increase the thickness of the reed valve 51 to increase reliability of the strength of the reed valve 51. However, because such an increase in the thickness of the reed valve causes difficulty in opening the reed valve 51, a pressure loss is caused, and the performance of the scroll compressor 100L is thereby decreased. In addition, such an increase in the thickness of the reed valve 51 also causes cost increase.

With the scroll compressor 100 of Embodiment 1 including the valve supporting portion 52*b* in the valve seat 52, the amount of bending of the reed valve 51 can be minimized, and reliability of the strength of the reed valve 51 can be ensured without changing the thickness of the reed valve 51.

In addition, the valve supporting portion 52*b* includes the tip portion, that is, an end on the compression chamber 5*a* side having a sharp shape. Thus, with the valve supporting portion 52*b*, due to the shape of the support tip portion 52*b*1, the pressure loss of the high-pressure gas flowing from the compression chamber 5*a* toward the discharge chamber 13 can be reduced.

The valve supporting portion 52*b* is tilted so that the upper end portion 52*b*12 is closer, than the lower end portion 52*b*11, to the distal end portion 51*b* of the reed valve 51 in top view. With the valve supporting portion 52*b* having this configuration, a greater portion of the gas flowing from the compression chamber 5*a* toward the discharge chamber 13 flows toward the distal end portion 51*b* of the reed valve 51, and the reed valve 51 is thereby easily opened, compared with when the valve supporting portion 52*b* is not tilted.

Embodiment 2

Figure 9:
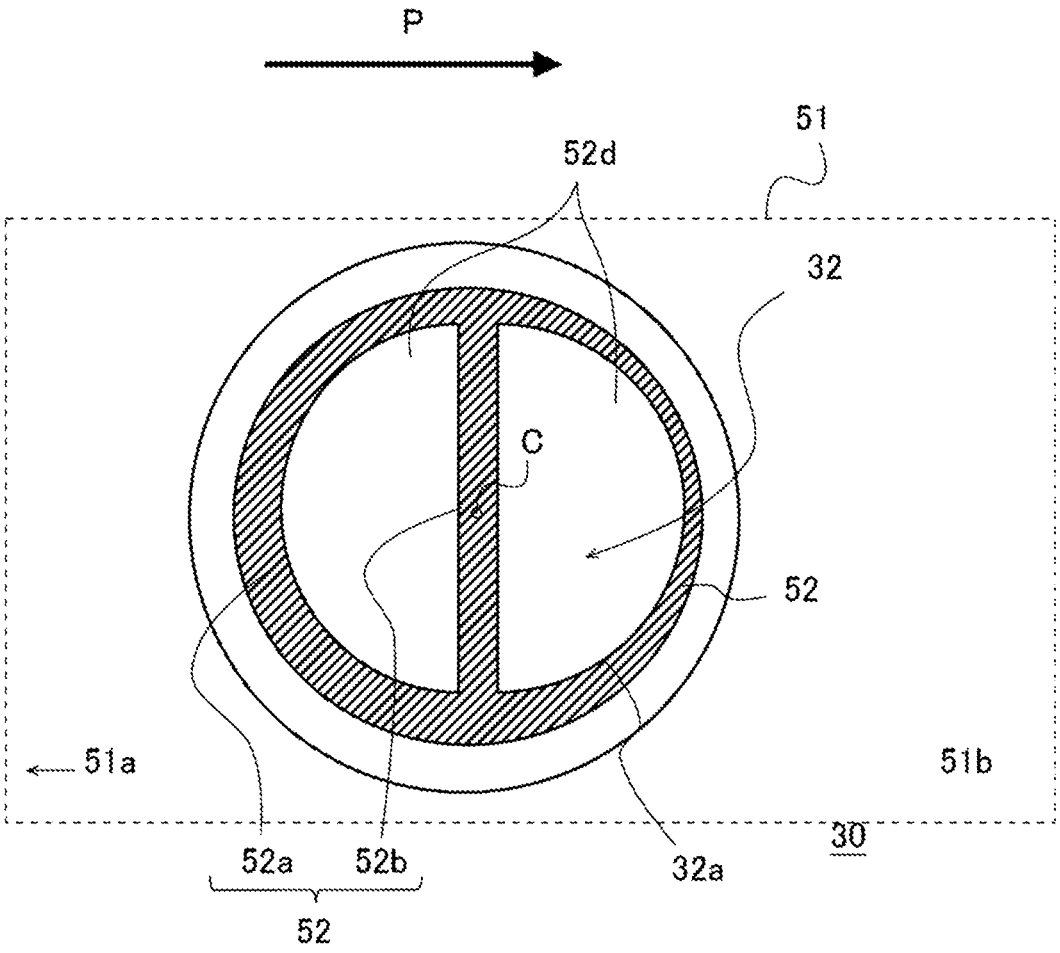
FIG. 9 is a top view of a valve seat of a scroll compressor according to Embodiment 2.

FIG. 9 is a top view of a valve seat 52 of a scroll compressor 100 according to Embodiment 2. Note that, in FIG. 9, for illustrating the structure of the valve seat 52, the reed valve 51 is illustrated by the dotted line as a transparent part. In the scroll compressor 100 of Embodiment 2, parts having the same configurations as those of the scroll compressor 100 illustrated in FIGS. 1 to 8 are denoted by the same references, and the descriptions thereof will be omitted. The distinct features of the scroll compressor 100 of Embodiment 2, that is, differences from the scroll compressor 100 illustrated in FIGS. 1 to 8 will be described. The width of the wall of the valve seat 52 varies depending on spots at which the reed valve 51 sits on the valve seat 52.

In the valve seat 52 of the scroll compressor 100 according to Embodiment 2, in the horizontal direction, the width in a region of the distal end portion 51*b* of the reed valve 51 differs from the width in a region of the fixed portion 51*a* of the reed valve 51. More specifically, as FIG. 9 illustrates, the valve seat 52 is formed so that the width of an annular portion 52*a* in the horizontal direction is decreased as advancing in a distal end direction P of the reed valve 51. In the valve seat 52, the width of the annular portion 52*a* in the horizontal direction decreases as advancing in the direction from the fixed portion 51*a* of the reed valve 51 toward the distal end portion 51*b* of the reed valve 51. Note that the horizontal direction is a direction perpendicular to the axial direction of the shaft portion 7. In the annular portion 52*a*, relative to a central spot C of the opening of the annular portion 52*a*, the width on one side is smaller than the width on the other side.

Advantageous Effects of Embodiment 2

In the valve seat 52, the width of the annular portion 52*a* in the horizontal direction decreases as advancing in the direction from the fixed portion 51*a* of the reed valve 51 toward the distal end portion 51*b* of the reed valve 51. With this configuration, because the reed valve 51 is opened from the distal end portion 51*b* side when opened, the reed valve 51 is more easily opened than the reed valve 51 including the valve seat 52 having the same width on the distal end portion 51*b* side and on the fixed portion 51*a* side. Thus, with the scroll compressor 100, an over-compression loss when the reed valve 51 is opened can be reduced, compared with when the valve seat 52 have the same width on the distal end portion 51*b* side and the fixed portion 51*a* side.

Note that, regarding the oil-film rapture resistance between the reed valve 51 and the valve seat 52 when the reed valve 51 is opened, in the reed valve 51, the oil-film rupture resistance on the distal end portion 51*b* side is larger than the oil-film rupture resistance of the fixed portion 51*a* in most cases. With the scroll compressor 100 having the above-described configuration, the oil-film rapture resistance on the distal end portion 51*b* side can be reduced, and the valve-opening timing can be optimized, compared with when the valve seat 52 has the same width on the distal end portion 51*b* side and the fixed portion 51*a* side.

Embodiment 3

Figure 10:
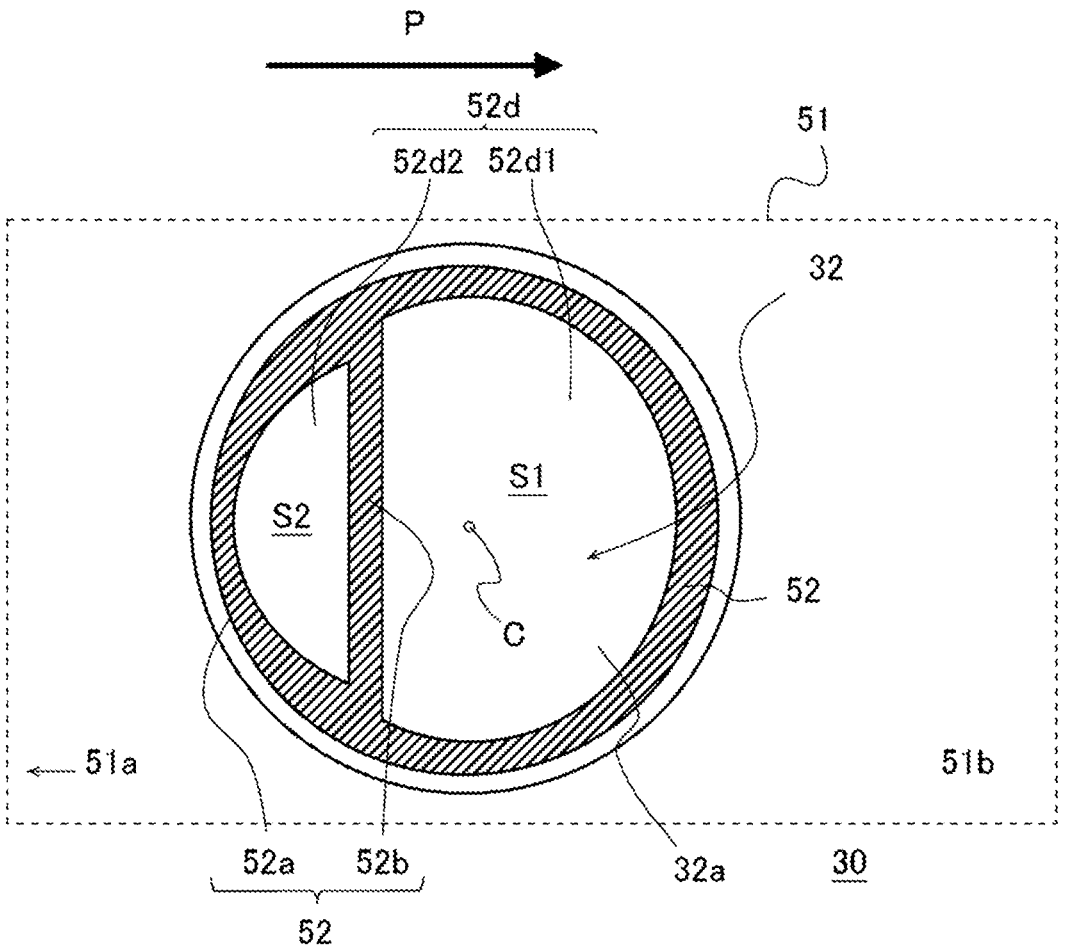
FIG. 10 is a top view of a valve seat of a scroll compressor according to Embodiment 3.

FIG. 10 is a top view of a valve seat 52 of a scroll compressor 100 according to Embodiment 3. Note that, in FIG. 10, for illustrating the structure of the valve seat 52, the reed valve 51 is illustrated by the dotted line as a transparent part. In the scroll compressor 100 of Embodiment 3, parts having the same configurations as those of the scroll compressors 100 illustrated in FIGS. 1 to 9 are denoted by the same references, and the descriptions thereof will be omitted. The distinct features of the scroll compressor 100 of Embodiment 3, that is, differences from the scroll compressors 100 illustrated in FIGS. 1 to 9 will be described. The valve seat 52 has plural valve seat holes 52*d* having different sizes. The plural valve seat holes 52*d* include at least a first valve seat hole 52*d*1 and a second valve seat hole 52*d*2.

In the scroll compressor 100 according to Embodiment 3, the position of a valve supporting portion 52*b* is offset from the central spot C of the opening of an annular portion 52*a*, and an opening area S1 of the first valve seat hole 52*d*1 is thus larger than an opening area S2 of the second valve seat hole 52*d*2. The first valve seat hole 52*d*1 is a through hole formed closer, than the second valve seat hole 52*d*2, to the distal end portion 51*b* of the reed valve 51, and the second valve seat hole 52*d*2 is a through hole formed closer, than the first valve seat hole 52*d*1, to the fixed portion 51*a* of the reed valve 51. The valve supporting portion 52*b* is disposed, inside the opening of the annular portion 52*a*, on the fixed portion 51*a* side relative to the central spot C.

Advantageous Effects of Embodiment 3

The opening area S1 of the first valve seat hole 52*d*1 is larger than the opening area S2 of the second valve seat hole 52*d*2. With the scroll compressor 100 having this configuration, the amount of the gas passing through the first valve seat hole 52*d*1 is larger than the amount of the gas passing through the second valve seat hole 52*d*2. That is, in the reed valve 51, more gas pushes up the distal end portion 51*b* region than pushes up the fixed portion 51*a* region of the reed valve 51. Thus, in the scroll compressor 100, the reed valve 51 is easily opened compared with when the opening area S1 and the opening area S2 of the valve seat holes 52*d* are the same. As a result, with the scroll compressor 100, an over-compression loss when the reed valve 51 is opened can be reduced, compared with when the opening area S1 and the opening area S2 of the valve seat holes 52*d* are the same.

Embodiment 4

Figure 11:
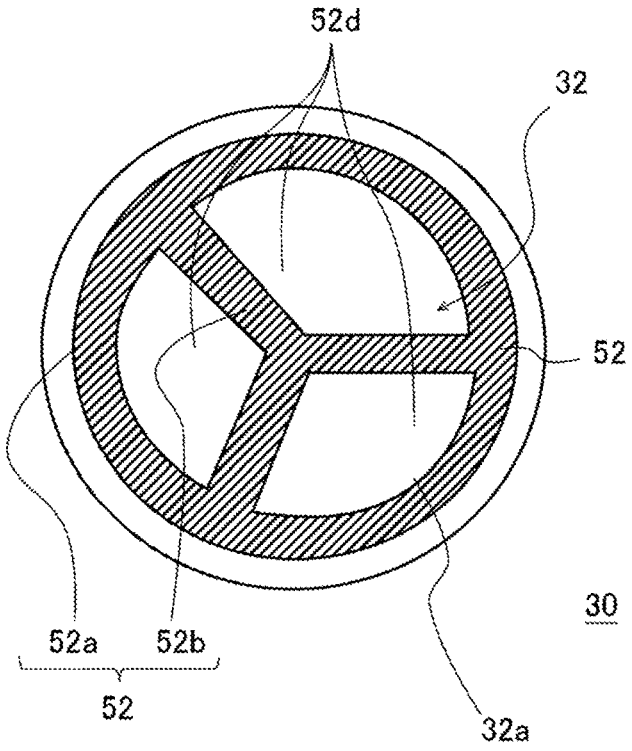
FIG. 11 is a top view of a valve seat of a scroll compressor according to Embodiment 4.

FIG. 11 is a top view of a valve seat 52 of a scroll compressor 100 according to Embodiment 4. In the scroll compressor 100 of Embodiment 4, parts having the same configurations as those of the scroll compressors 100 illustrated in FIGS. 1 to 10 are denoted by the same references, and the descriptions thereof will be omitted. The distinct features of the scroll compressor 100 of Embodiment 4, that is, differences from the scroll compressors 100 illustrated in FIGS. 1 to 10 will be described.

The valve supporting portion 52*b* in Embodiment 1 has an "I" shape whereas a valve supporting portion 52*b* in Embodiment 4 has a "Y" shape, when viewed, in plan, in the axial direction of the shaft portion 7. The valve seat 52 in Embodiment 1 has two valve seat holes 52*d* whereas the valve seat 52 in Embodiment 4 has three valve seat holes 52*d*.

Advantageous Effects of Embodiment 4

The valve supporting portion 52*b* has a "Y" shape when viewed, in plan, in the axial direction of the shaft portion 7. The valve supporting portion 52*b* of Embodiment 4 includes more portions continuous from the annular portion 52*a* than the valve supporting portion 52*b* of Embodiment 1. Thus, reliability of the strength of the valve supporting portion 52*b* of Embodiment 4 can be ensured compared with the valve supporting portion 52*b* of Embodiment 1.

Embodiment 5

Figure 12:
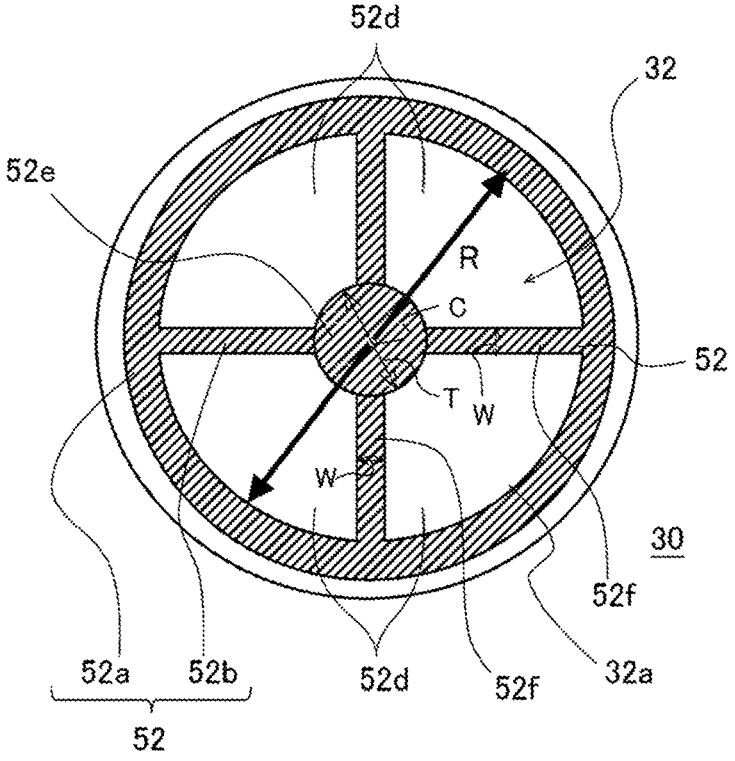
FIG. 12 is a top view of a valve seat of a scroll compressor according to Embodiment 5.

FIG. 12 is a top view of a valve seat 52 of a scroll compressor 100 according to Embodiment 5. In the scroll compressor 100 of Embodiment 5, parts having the same configurations as those of the scroll compressors 100 illustrated in FIGS. 1 to 11 are denoted by the same references, and the descriptions thereof will be omitted. The distinct features of the scroll compressor 100 of Embodiment 5, that is, differences from the scroll compressors 100 illustrated in FIGS. 1 to 11 will be described.

The valve supporting portion 52*b* in Embodiment 1 has an "I" shape whereas a valve supporting portion 52*b* in Embodiment 5 has an "X" shape, when viewed, in plan, in the axial direction of the shaft portion 7. The valve seat 52 in Embodiment 1 has two valve seat holes 52*d* whereas the valve seat 52 in Embodiment 5 has four valve seat holes 52*d*.

As FIG. 12 illustrates, the valve supporting portion 52*b* may have a valve receiving portion 52*e* at the central spot C of the opening of the annular portion 52*a*. The valve receiving portion 52*e*, with the annular portion 52*a*, is in contact with the reed valve 51 when the reed valve 51 sits on the valve seat 52.

The valve receiving portion 52*e* has, for example, a columnar shape. A portion, of the valve receiving portion 52*e*, facing the reed valve 51 has a circular shape when viewed, in plan, in the axial direction of the shaft portion 7. A diameter T of the valve receiving portion 52*e* is larger than a width W of a support portion 52*f*. The support portion 52*f* constitutes a portion between the valve receiving portion 52*e* and the annular portion 52*a* and supports the valve receiving portion 52*e*. Thus, in the valve supporting portion 52*b*, only the area of the central portion inside the opening of the annular portion 52*a* may be increased, and the widths of other portions may be reduced compared with the central portion.

Regarding the valve supporting portion 52*b*, the valve receiving portion 52*e* that receives the reed valve 51 preferably has a diameter nearly equal to one-seventh to one-third of a diameter R of the opening of the annular portion 52*a*. Note that the valve receiving portion 52*e* preferably has such a size described above even when the valve receiving portion 52*e* is not circular and has a different shape such as a square shape or another polygonal shape.

Advantageous Effects of Embodiment 5

The valve supporting portion 52*b* has an "X" shape when viewed, in plan, in the axial direction of the shaft portion 7. The valve supporting portion 52*b* of Embodiment 5 includes more portions continuous from the annular portion 52*a* than the valve supporting portion 52*b* of Embodiment 1. Thus, reliability of the strength of the valve supporting portion 52*b* of Embodiment 5 can be ensured compared with the valve supporting portion 52*b* of Embodiment 1.

Regarding a portion, of the valve supporting portion 52*b*, facing the reed valve 51, the diameter T of the valve receiving portion 52*e* is larger than the width W of the support portion 52*f*. With the scroll compressor 100 of Embodiment 5 in which the diameter T of the valve receiving portion 52*e* is larger than the width W of the support portion 52*f*, the area of a portion with which the reed valve 51 is in contact can be ensured. In addition, with the scroll compressor 100 of Embodiment 5 in which the width W of the support portion 52*f* is smaller than the diameter T of the valve receiving portion 52*e*, the opening area of each of the valve seat holes 52*d* can be ensured. As a result, with the scroll compressor 100 of Embodiment 5, a pressure loss can also be reduced while reliability in supporting the reed valve 51 can be increased.

Embodiment 6

Figure 13:
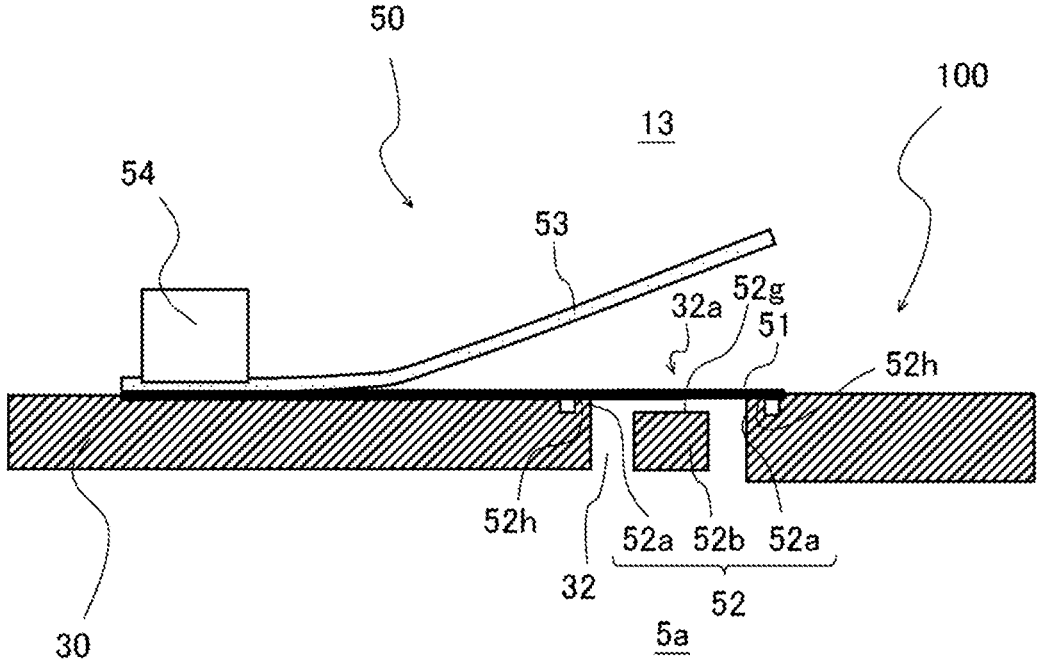
FIG. 13 is a schematic sectional view of a discharge valve mechanism of a scroll compressor according to Embodiment 6.

FIG. 13 is a schematic sectional view of a discharge valve mechanism 50 of a scroll compressor 100 according to Embodiment 6. In the scroll compressor 100 of Embodiment 6, parts having the same configurations as those of the scroll compressors 100 illustrated in FIGS. 1 to 12 are denoted by the same references, and the descriptions thereof will be omitted. The distinct features of the scroll compressor 100 of Embodiment 6, that is, differences from the scroll compressors 100 illustrated in FIGS. 1 to 12 will be described.

In Embodiment 1, the surfaces, of the annular portion 52*a* and the valve supporting portion 52*b*, on the discharge chamber 13 side are flush with one another. However, in Embodiment 6, the surfaces, of the annular portion 52*a* and a valve supporting portion 52*b*, on the discharge chamber 13 side are not flush with one another.

A valve supporting portion 52*b* is disposed closer, than the annular portion 52*a*, to the compression chamber 5*a* side. More specifically, a support surface 52*g*, of the valve supporting portion 52*b*, facing the reed valve 51 is disposed closer to the compression chamber 5*a* than a support surface 52*h*, of the annular portion 52*a*, facing the reed valve 51. According to Embodiment 6, the height of a wall surface of the valve supporting portion 52*b* dividing the opening of the valve seat 52 into portions is not necessarily the same as the height of the surface, of the annular portion 52*a*, on the discharge chamber 13 side, as long as the height with which the reed valve 51 is suppressed from bending can be ensured.

The valve supporting portion 52*b* is not necessarily flush with the support surface 52*h*, of the annular portion 52*a*, serving as a surface to be sealed and may be recessed toward the compression chamber 5*a* side to a degree. With the valve supporting portion 52*b* at a level lower than the level of the annular portion 52*a*, the reed valve 51 bends to a degree when closed. However, the opening of the valve can be improved because the contact area between the reed valve 51 and gas is increased. In contrast, it is not preferable that the valve supporting portion 52*b* protrudes toward the discharge chamber 13 beyond the support surface 52*h*, of the annular portion 52*a*, serving as a surface to be sealed, because the sealing performance between the reed valve 51 and the valve seat 52 is decreased.

Advantageous Effects of Embodiment 6

The support surface 52*g*, which is the surface of the valve supporting portion 52*b* on the discharge chamber 13 side, is closer to the compression chamber 5*a* than the support surface 52*h*, which is the surface of the annular portion 52*a* on the discharge chamber 13 side. Although division of the discharge port 32 increases the surface area of the wall surface with which the compressed refrigerant gas is in contact, the valve seat 52 having this configuration enables a reduction in the surface area of the wall surface and a reduction in a pressure loss.

Embodiment 7

Figure 14:
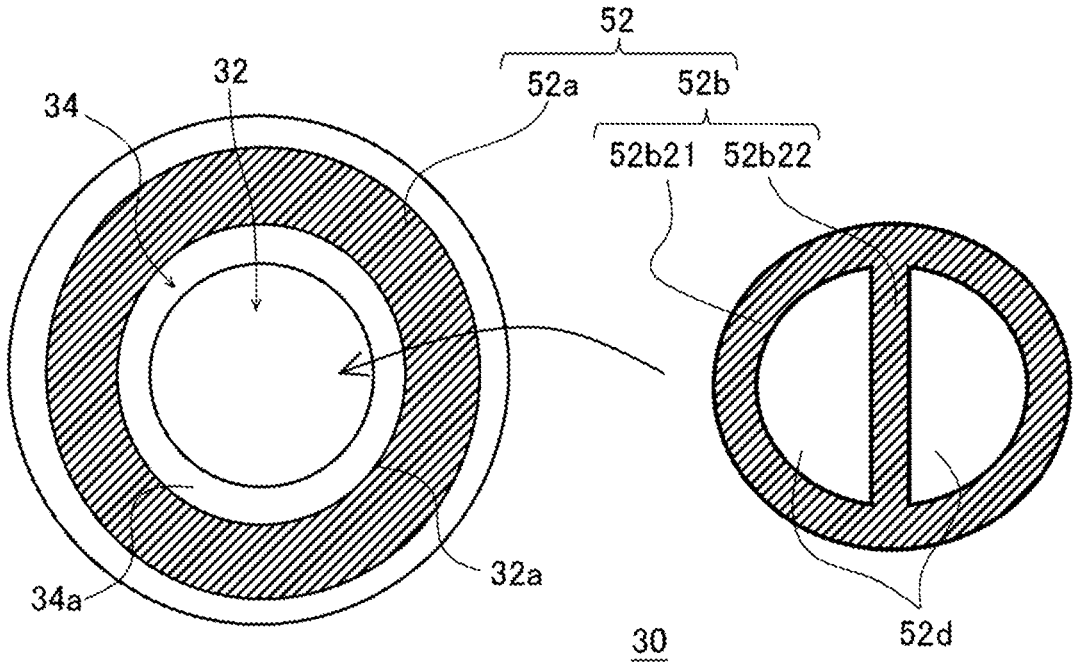
FIG. 14 conceptually illustrates a valve seat of a scroll compressor according to Embodiment 7.
Figure 15:
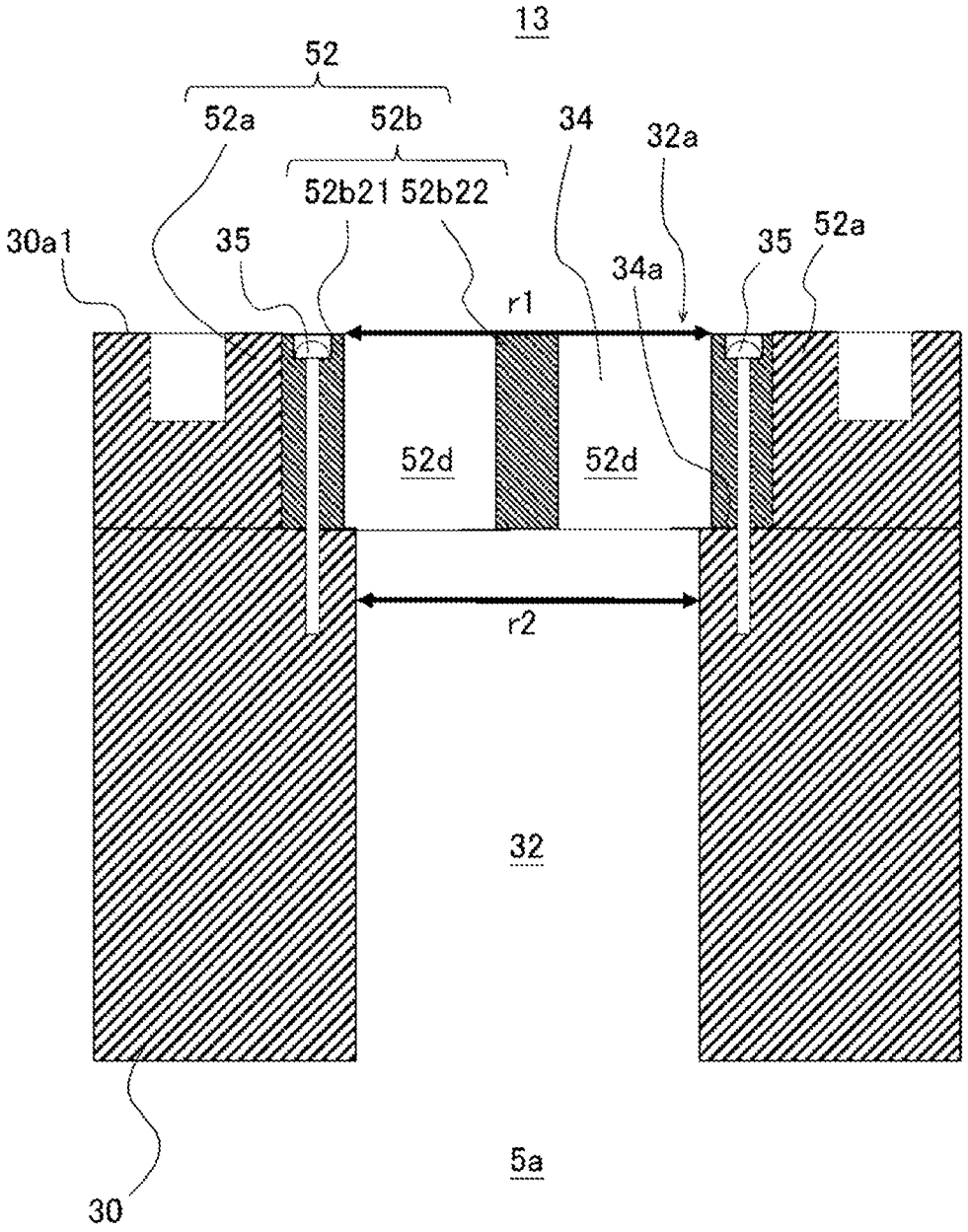
FIG. 15 is a schematic longitudinal sectional view of the valve seat of the scroll compressor according to Embodiment 7.

FIG. 14 conceptually illustrates a valve seat 52 of a scroll compressor 100 according to Embodiment 7. FIG. 15 is a schematic longitudinal sectional view of the valve seat 52 of the scroll compressor 100 according to Embodiment 7. In the scroll compressor 100 of Embodiment 7, parts having the same configurations as those of the scroll compressors 100 illustrated in FIGS. 1 to 13 are denoted by the same references, and the descriptions thereof will be omitted. The distinct features of the scroll compressor 100 of Embodiment 7, that is, differences from the scroll compressors 100 illustrated in FIGS. 1 to 13 will be described.

The valve seat 52 of Embodiment 1 includes the annular portion 52*a* and the valve supporting portion 52*b* that are formed as one body. In contrast, the valve seat 52 of Embodiment 7 includes an annular portion 52*a* and a valve supporting portion 52*b* that are formed as separated bodies.

As FIG. 14 and FIG. 15 illustrate, the outlet portion 32*a* of the discharge port 32 has a recessed portion 34 when the annular portion 52*a* and the valve supporting portion 52*b* are formed as separated bodies. The recessed portion 34 is formed by a portion of the surface portion 30*a*1 of the fixed scroll 30 being recessed along the discharge port 32, and the recessed portion 34 is recessed to the compression chamber 5*a* side from the discharge chamber 13 side. The recessed portion 34 is formed in an inner circumferential portion of the annular portion 52*a*. The recessed portion 34 includes a bottom portion 34*a* having an annular shape in plan view, and there is a difference in level between the bottom portion 34*a* and the surface portion 30*a*1 of the fixed scroll 30. The inside diameter of the recessed portion 34 is larger than the inside diameter of the discharge port 32 provided between the recessed portion 34 and the compression chamber 5*a*.

The valve supporting portion 52*b* is fitted in an inner circumferential region in the recessed portion 34 and is disposed inside the recessed portion 34. The valve supporting portion 52*b* is fixed to the outlet portion 32*a* of the fixed scroll 30 by a fixing part 35 such as a screw. The valve supporting portion 52*b* is disposed in a region surrounded by the inner circumference of the annular portion 52*a* and constitutes, with the annular portion 52*a*, the valve seat 52.

The valve supporting portion 52*b* includes an outer circumferential portion 52*b*21 having a circular annular shape and a partition portion 52*b*22. The partition portion 52*b*22 is provided in a region surrounded by the inner circumference of the outer circumferential portion 52*b*21 and divides the opening of the outlet portion 32*a* into plural valve seat holes 52*d* that are through holes. The outer circumferential portion 52*b*21 may have any shape that is fitted to the annular portion 52*a* when viewed, in plan, in the axial direction of the shaft portion 7 in FIG. 1. For example, the shape of the outer circumferential portion 52*b*21 is not limited to a circular annular shape and may have a non-circular annular shape.

Here, the inside diameter of the outer circumferential portion 52*b*21 is defined as an inside diameter r1, and the inside diameter of the discharge port 32 is defined as an inside diameter r2. Note that the inside diameter r1 is also the inside diameter of the valve seat 52. The inside diameter r1 of the outer circumferential portion 52*b*21 is preferably larger than the inside diameter r2 of the discharge port 32 (inside diameter r1>inside diameter r2). With this configuration, the high-pressure gas discharged from the discharge port 32 can be prevented from being blown against a peripheral portion of the valve seat 52 such as the outer circumferential portion 52*b*21, and the pressure loss of the high-pressure gas can be reduced.

The partition portion 52*b*22 has a rod shape so as to serve as a bridge between inner wall portions, of the outer circumferential portion 52*b*21, facing one another. Although the partition portion 52*b*22 has an "I" shape when viewed, in plan, in the axial direction of the shaft portion 7, such a shape is not the only option. The partition portion 52*b*22 may have another shape such as a "Y" shape or an "X" shape. Although the valve seat 52 of Embodiment 7 has two valve seat holes 52*d*, the number of valve seat holes 52*d* is not limited to two.

Advantageous Effects of Embodiment 7

The valve seat 52 of Embodiment 7 includes the annular portion 52*a* and the valve supporting portion 52*b* that are formed as separated bodies. According to the configuration, the outlet portion 32*a* of the fixed scroll 30 is easily processed, and the processing time of the fixed scroll 30 is not thereby increased. Thus, the manufacturing costs can be prevented from being increased. In addition, the configuration enables easy processing of the valve seat 52, and, for example, the valve seat 52 in which the inside diameter r1 is larger than the inside diameter r2 is easily processed. With the scroll compressor 100 in which the inside diameter r1 of the valve seat 52 is larger than the inside diameter r2 of the discharge port 32, the surface area of the wall surface with which the compressed refrigerant gas is in contact when in contact with the valve seat 52 can be reduced, and the pressure loss of the refrigerant gas can be reduced.

Embodiment 8

Figure 16:
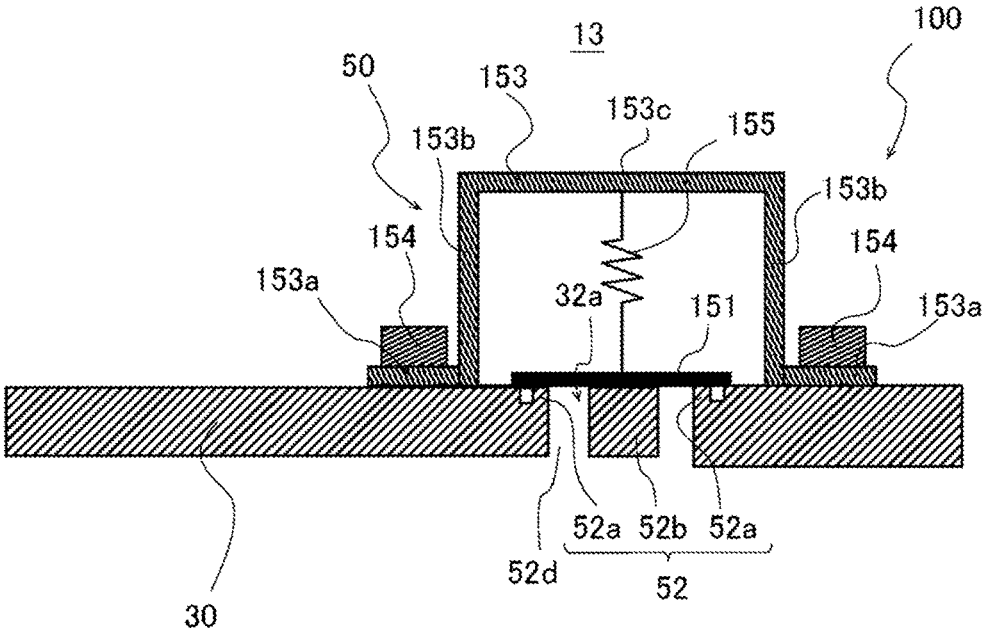
FIG. 16 is a schematic sectional view of a discharge valve mechanism of a scroll compressor according to Embodiment 8.
Figure 17:
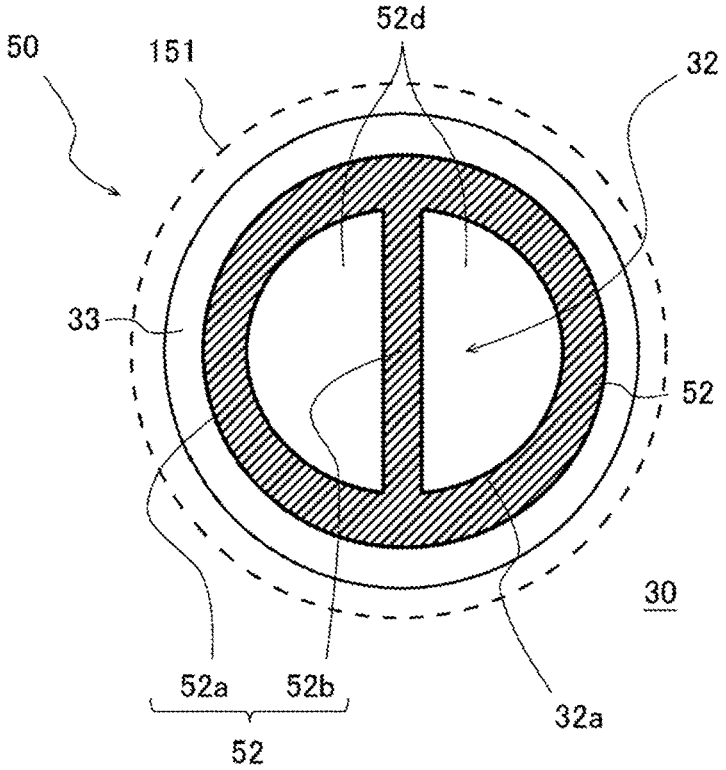
FIG. 17 is an enlarged top view conceptually illustrating a region including a valve seat of the scroll compressor according to Embodiment 8.

FIG. 16 is a schematic sectional view of a discharge valve mechanism 50 of a scroll compressor 100 according to Embodiment 8. FIG. 17 is an enlarged top view conceptually illustrating a region including a valve seat 52 of the scroll compressor 100 according to Embodiment 8. In the scroll compressor 100 of Embodiment 8, parts having the same configurations as those of the scroll compressors 100 illustrated in FIGS. 1 to 15 are denoted by the same references, and the descriptions thereof will be omitted. The distinct features of the scroll compressor 100 of Embodiment 8, that is, differences from the scroll compressors 100 illustrated in FIGS. 1 to 15 will be described.

The discharge valve mechanism 50 may include a float valve 151 instead of the reed valve 51. For example, the float valve 151 can be adopted for the discharge valve mechanism 50, instead of the reed valve 51, when there is no space for radially disposing the reed valve 51 on a portion of the fixed scroll 30 on the discharge chamber 13 side. In Embodiment 8, the configuration including the float valve 151 is used, instead of the reed valve 51, in the discharge valve mechanism 50 will be described.

As FIG. 16 and FIG. 17 illustrate, the discharge valve mechanism 50 includes one float valve 151 and the valve seat 52 on which the float valve 151 sits. The discharge valve mechanism 50 further includes a float valve retainer 153 including a top panel portion 153*c* that is disposed inside the discharge chamber 13, while being spaced from the outlet portion 32*a*, so as to face the valve seat 52. The discharge valve mechanism 50 also includes a compression spring 155 provided between the top panel portion 153*c* and the float valve 151.

(Float Valve 151)

The float valve 151 opens and closes the outlet portion 32*a* of the discharge port 32 depending on the discharge pressure of refrigerant. The float valve 151 is moved away from the valve seat 52 by the discharge gas that is discharged through the compression operation of the scroll compressor 100 and thus opens the opening of the outlet portion 32*a*. The float valve 151 is moved to sit on the valve seat 52 by suction caused through the compression process of the scroll, the weight of the float valve 151, and the spring force of the compression spring 155. The float valve 151 is provided on a portion, of the compression mechanism unit 5, on the discharge chamber 13 side and is disposed so as to cover the outlet portion 32*a* that is the outlet-side opening end of the discharge port 32.

The float valve 151 has a plate shape. Although the float valve 151 has a circular shape in FIG. 17, the shape of the float valve 151 is not limited to such a shape as long as a valve seat surface of the valve seat 52 can be sealed with the float valve 151.

In the float valve 151, in a direction in which the flow passage of the discharge port 32 (refer to FIG. 1) runs, the compression spring 155 is mounted on a surface on one side, and a surface on the other side sits on and is contact with the valve seat 52.

The float valve 151 closes the valve seat 52 when sitting on the valve seat 52. When sitting on the valve seat 52, the float valve 151 is in contact with at least a portion of the valve supporting portion 52*b* and with the annular portion 52*a*. The float valve 151 is disposed so as to move between the top panel portion 153*c* and the valve seat 52, and the float valve 151 is pressed against the valve seat 52 by the biasing force of the compression spring 155.

(Float Valve Retainer 153)

The float valve retainer 153 supports the float valve 151. The float valve retainer 153 has a tubular shape so that the float valve 151 can move vertically, and the float valve retainer 153 has an opening in a side wall for preventing the discharge gas discharged from the discharge port 32 from being trapped inside the float valve retainer 153. Note that the float valve retainer 153 may be any part that supports the float valve 151, and the form thereof is not limited to a tubular shape.

The float valve retainer 153 includes a fixed portion 153*a*, a side wall portion 153*b*, and the top panel portion 153*c*. The fixed portion 153*a* is fixed to the fixed scroll 30 of the compression mechanism unit 5 by, for example, a fixing tool 154 such as a screw. The side wall portion 153*b* is a wall portion extending between the fixed portion 153*a* and the top panel portion 153*c*, and, with the side wall portion 153*b*, the top panel portion 153*c* is disposed above the outlet portion 32*a*. The top panel portion 153*c* is disposed inside the discharge chamber 13, while being spaced from the outlet portion 32*a*, so as to face the valve seat 52. The top panel portion 153*c* is connected to and supports the float valve 151 with the compression spring 155 interposed therebetween.

(Compression Spring 155)

The compression spring 155 receives the load exerted in a compression direction, and the reaction force of the compression spring 155 generated by being compressed is used. The compression spring 155 presses the float valve 151 against the valve seat 52 by using such a reaction force when compressed. When the float valve 151 is pushed upward by the high-pressure gas issued from the discharge port 32, the compression spring 155 receives the load exerted in the compression direction by the float valve 151, and, by using the reaction force when compressed, the compression spring 155 presses the float valve 151 in a direction in which the float valve 151 is pressed against the valve seat 52.

In the scroll compressor 100 according to Embodiment 8, the valve supporting portion 52*b* may be tilted relative to the running direction of the flow passage of the discharge port 32 as in Modification 2 of the valve supporting portion 52*b* according to Embodiment 1 (refer to FIG. 6). Unlike the reed valve 51, the float valve 151 does not have a configuration in which the valve is opened from the distal end portion 51*b*. Thus, when the outlet portion 32*a* is viewed vertically, the direction in which the valve supporting portion 52*b* is tilted, that is, the extending direction of the valve supporting portion 52*b* is not limited.

In the scroll compressor 100 according to Embodiment 8, the annular portion 52*a* may be formed in the same manner as the annular portion 52*a* according to Embodiment 2 (refer to FIG. 9). That is, in the annular portion 52*a*, relative to the central spot C of the opening of the annular portion 52*a*, the width on one side may be smaller than the width on the other side. Unlike the reed valve 51, the float valve 151 does not have a configuration in which the valve is opened from the distal end portion 51*b*. Thus, in the circumferential direction centering on the central spot C of the opening of the annular portion 52*a*, in the annular portion 52*a*, the position of the small-width portion on one side and the position of the large-width portion on the other side are not limited.

In the scroll compressor 100 according to Embodiment 8, plural valve seat holes 52*d* may be formed in the same manner as the plural valve seat holes 52*d* according to Embodiment 3 (refer to FIG. 10). That is, in the scroll compressor 100 according to Embodiment 8, the position of the valve supporting portion 52*b* may be offset from the central spot C of the opening of the annular portion 52*a*, and the opening area S1 of the first valve seat hole 52*d*1 may thus be larger than the opening area S2 of the second valve seat hole 52*d*2. Relative to the central spot C of the opening of the annular portion 52*a*, the first valve seat hole 52*d*1 is a through hole formed on one side, and the second valve seat hole 52*d*2 is a through hole formed on the other side. Unlike the reed valve 51, the float valve 151 does not have a configuration in which the valve is opened from the distal end portion 51*b*. Thus, the direction in which the position of the valve supporting portion 52*b* is offset from the central spot C of the opening of the annular portion 52*a* is not limited.

Advantageous Effects of Embodiment 8

Figure 18:
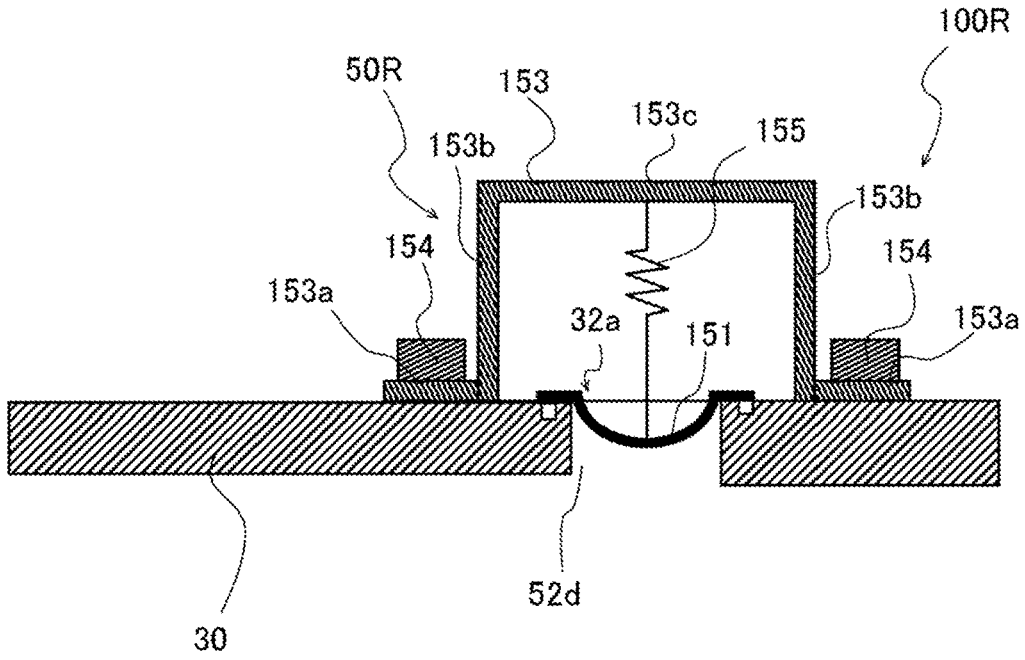
FIG. 18 is a schematic sectional view of a discharge valve mechanism of a scroll compressor according to a comparative example.

FIG. 18 is a schematic sectional view of a discharge valve mechanism 50R of a scroll compressor 100R according to a comparative example. The scroll compressor 100R according to the comparative example includes no valve supporting portion 52*b* in the valve seat 52. As FIG. 18 illustrates, the scroll compressor 100R according to the comparative example includes the float valve 151 that bends inside the discharge port 32 when sitting on the valve seat 52. In the scroll compressor 100 having a structure including the float valve 151, as in a structure including the reed valve 51, the valve is also bent by the load exerted at the time of valve closure when the valve supporting portion 52*b* is not provided. Without the valve supporting portion 52*b*, the float valve 151 is bent at a portion that does not sit on any portion, as with the reed valve 51.

The float valve 151 is in contact with the valve seat 52 at plural spots including a spot at which the float valve 151 faces the edge portion of the outlet portion 32*a*, and the amount of bending of the float valve 151 can thereby be dispersed. Thus, the amount of bending of the float valve 151 due to the load exerted at the time of sitting can be minimized. As a result, because the amount of bending the float valve 151 is minimized, the float valve 151 can be suppressed from being damaged by bending. Thus, reliability of the strength of the float valve 151 can be ensured.

<Refrigeration Cycle Apparatus 200>

Figure 19:
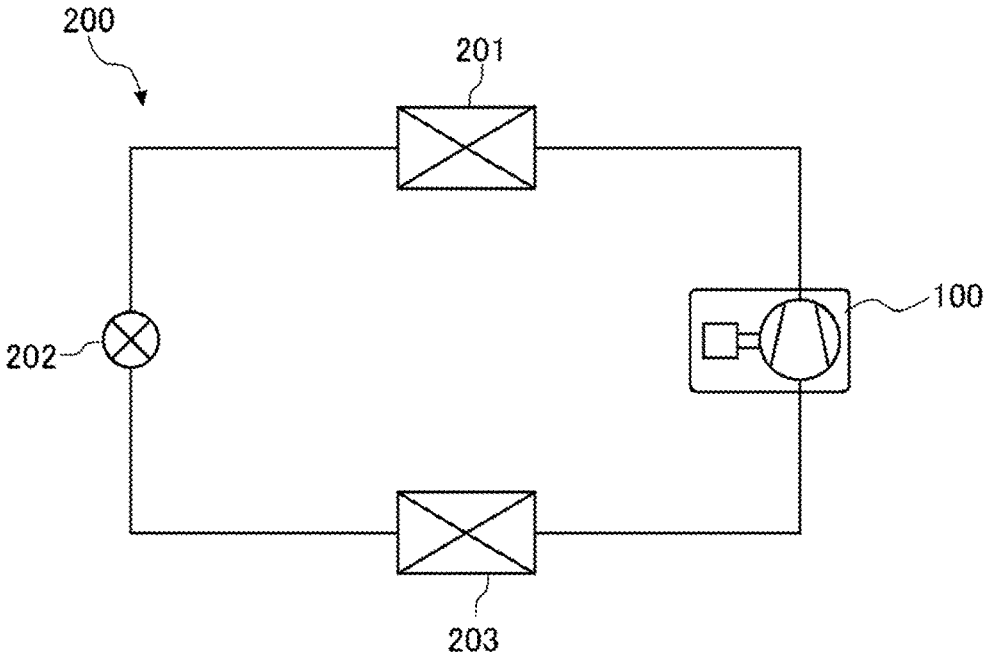
FIG. 19 is a schematic view of a refrigeration cycle apparatus including any one of the scroll compressors according to Embodiments 1 to 8.

FIG. 19 is a schematic view of the refrigeration cycle apparatus 200 including any one of the scroll compressors 100 according to Embodiments 1 to 8. The refrigeration cycle apparatus 200 includes the scroll compressor 100, a condenser 201, an expansion valve 202, and an evaporator 203. As FIG. 19 illustrates, in the refrigeration cycle apparatus 200, the scroll compressor 100, the condenser 201, the expansion valve 202, and the evaporator 203 are connected to one another by refrigerant pipes so as to configure a refrigerant cycle circuit.

The scroll compressor 100 that is any one of the scroll compressors 100 of Embodiments 1 to 8 compresses the low-pressure gas-phase refrigerant sucked inside the scroll compressor 100 into high-temperature and high-pressure gas-phase refrigerant. The high-temperature and high-pressure refrigerant is condensed in the condenser 201 and thus turns into liquid refrigerant. The liquid refrigerant is reduced in pressure and expanded, by the expansion valve 202, to turn into low-temperature and low-pressure two-phase gas-liquid refrigerant, and the two-phase gas-liquid refrigerant is subjected to heat exchange in the evaporator 203. The refrigerant that has flowed out of the evaporator 203 is sucked into the scroll compressor 100 and turns into high-temperature and high-pressure gas-phase refrigerant.

The refrigeration cycle apparatus 200 includes any one of the scroll compressors 100 of Embodiments 1 to 8. Thus, the refrigeration cycle apparatus 200 can exhibit the same advantageous effects as those exhibited by any one of the above-described scroll compressors 100.

Note that embodiments of the present disclosure are not limited to Embodiments 1 to 8 described above and may be applied by being changed appropriately without departing from the spirit of the present disclosure. For example, regarding the shape of a valve seat hole 52*d*, the fan-shaped valve seat holes 52*d* are given as an example. However, such a fan shape is not the only option, and another shape such as an oval shape, a long hole shape, a strip shape, or an arc shape may be possible. The shapes of plural valve seat holes 52*d* may be the same or may be different. In addition, an embodiment of the present disclosure may be configured by combining ones of the configurations of Embodiments 1 to 8.

REFERENCE SIGNS LIST

2: shell, 2*a*: upper shell, 2*b*: lower shell, 2*c*: middle shell, 3: oil pump, 3*a*: oil sump, 4: motor, 4*a*: rotor, 4*b*: stator, 5: compression mechanism unit, 5*a*: compression chamber, 6: frame, 6*a*: suction port, 6*b*: thrust bearing, 6*c*: oil supply groove, 6*d*: inner space, 7: shaft portion, 7*a*: oil passage, 7*b*: eccentric portion, 8*a*: main bearing, 8*b*: sub-bearing, 8*c*: orbiting bearing, 11: suction pipe, 12: discharge pipe, 13: discharge chamber, 15: Oldham ring, 15*b*: Oldham ring space, 16: slider, 17: sleeve, 18: first balancer, 18*a*: balancer cover, 19: second balancer, 20: sub-frame, 21: oil drain pipe, 30: fixed scroll, 30*a*: base plate, 30*a*1: surface portion, 31: spiral portion, 32: discharge port, 32*a*: outlet portion, 33: groove, 34: recessed portion, 34*a*: bottom portion, 35: fixing part, 40: orbiting scroll, 40*a*: base plate, 41: spiral portion, 42: boss portion, 50: discharge valve mechanism, 50L: discharge valve mechanism, 50R: discharge valve mechanism, 51: reed valve, 51*a*: fixed portion, 51*b*: distal end portion, 52: valve seat, 52*a*: annular portion, 52*b*: valve supporting portion, 52*b*1: support tip portion, 52*b*11: lower end portion, 52*b*12: upper end portion, 52*b*21: outer circumferential portion, 52*b*22: partition portion, 52*d*: valve seat hole, 52*d*1: first valve seat hole, 52*d*2: second valve seat hole, 52*e*: valve receiving portion, 52*f*: support portion, 52*g*: support surface, 52*h*: support surface, 53: valve retainer, 53*a*: fixed end portion, 53*b*: distal end portion, 54: fixing tool, 100: scroll compressor, 100L: scroll compressor, 100R: scroll compressor, 151: float valve, 153: float valve retainer, 153*a*: fixed portion, 153*b*: side wall portion, 153*c*: top panel portion, 154: fixing tool, 155: compression spring, 200: refrigeration cycle apparatus, 201: condenser, 202: expansion valve, 203: evaporator, C: central spot, L: thickness, L1: thickness, P: distal end direction, S: axial direction, S1: opening area, S2: opening area, r1: inside diameter, r2: inside diameter

The invention claimed is:

1. A scroll compressor comprising:

a shell defining an outline of a sealed container;

a compression mechanism unit accommodated in the shell and defining a compression chamber in which refrigerant is compressed, the compression mechanism unit having a discharge port that is a through hole through which a discharge chamber surrounded by the shell and the compression mechanism unit and the compression chamber communicate with one another;

a discharge valve mechanism that is provided on a portion, of the compression mechanism unit, facing the discharge chamber and opens and closes the discharge port, wherein the discharge valve mechanism includes:

a valve seat provided on an outlet portion of the discharge port that is an outlet-side opening end for refrigerant, and a valve that has a plate shape and closes the valve seat when sitting on the valve seat;

wherein the valve seat includes:

an annular portion serving as an edge of an opening of the outlet portion, and a valve supporting portion that is provided in a region surrounded by an inner circumference of the annular portion and divides the opening of the outlet portion into a plurality of valve seat holes that are through holes;

wherein the valve is in contact with at least a portion of the valve supporting portion and with the annular portion, when sitting on the valve seat; and wherein the valve seat includes the annular portion and the valve supporting portion that are formed as separated bodies.

2. The scroll compressor of claim 1, wherein the valve supporting portion includes a support tip portion that is a compression chamber-side end having a sharp shape.

3. The scroll compressor of claim 1, wherein the valve supporting portion includes:

a valve receiving portion provided at a central spot of an opening of the annular portion and having a columnar shape, and a support portion serving as a portion between the annular portion and the valve receiving portion and supporting the valve receiving portion; and wherein the valve receiving portion has a portion facing the valve that is circular in shape with a diameter, and in the portion facing the valve, the valve receiving portion is larger than a width of the support portion.

4. The scroll compressor of claim 1, wherein a discharge chamber-side surface of the valve supporting portion is provided closer to the compression chamber than a discharge chamber-side surface of the annular portion.

5. The scroll compressor of claim 1, wherein the valve has a long plate shape, includes a fixed portion mounted on the compression mechanism unit, includes a distal end portion that is a free end, and is a reed valve that closes the valve seat when the distal end portion sits on the valve seat.

6. The scroll compressor of claim 5, wherein the valve supporting portion is tilted so that, in top view, an upper end portion being a discharge chamber-side end portion is closer to the distal end portion of the reed valve than a lower end portion being a compression chamber-side end portion.

7. The scroll compressor of claim 5, wherein the valve seat is formed so that a width of the annular portion in a horizontal direction decreases as advancing in a direction from the fixed portion of the reed valve toward the distal end portion of the reed valve.

8. The scroll compressor of claim 5, wherein the plurality of valve seat holes include:

a first valve seat hole formed closer, than a central spot of an opening of the annular portion, to the distal end portion, and a second valve seat hole formed closer, than the central spot of the opening of the annular portion, to the fixed portion; and wherein the first valve seat hole has an opening area larger than an opening area of the second valve seat hole.

9. The scroll compressor of claim 1, wherein the discharge valve mechanism further includes:

a valve retainer including a top panel portion disposed inside the discharge chamber, while being spaced from the outlet portion, so as to face the valve seat, and a compression spring provided between the top panel portion and the valve; and wherein the valve is disposed so as to move between the top panel portion and the valve seat, and is pressed against the valve seat by the compression spring.

10. The scroll compressor of claim 9, wherein the valve supporting portion is tilted relative to a direction in which a flow passage of the discharge port runs.

11. The scroll compressor of claim 9, wherein in the annular portion, relative to a central spot of an opening of the annular portion, a width on one side is smaller than a width on another side.

12. The scroll compressor of claim 9, wherein the plurality of valve seat holes include:

a first valve seat hole formed on one side relative to a central spot of an opening of the annular portion, and a second valve seat hole formed on another side relative to the central spot of the opening of the annular portion; and wherein the first valve seat hole has an opening area larger than an opening area of the second valve seat hole.

13. A refrigeration cycle apparatus comprising the scroll compressor of claim 1.

14. A scroll compressor comprising:

a shell defining an outline of a sealed container;

a compression mechanism unit accommodated in the shell and defining a compression chamber in which refrigerant is compressed, the compression mechanism unit having a discharge port that is a through hole through which a discharge chamber surrounded by the shell and the compression mechanism unit and the compression chamber communicate with one another; and a discharge valve mechanism that is provided on a portion, of the compression mechanism unit, facing the discharge chamber and opens and closes the discharge port, wherein the discharge valve mechanism includes:

a valve seat provided on an outlet portion of the discharge port that is an outlet-side opening end for refrigerant, and a valve that has a plate shape and closes the valve seat when sitting on the valve seat;

wherein the valve seat includes:

an annular portion serving as an edge of an opening of the outlet portion, and a valve supporting portion that is provided in a region surrounded by an inner circumference of the annular portion and divides the opening of the outlet portion into a plurality of valve seat holes that are through holes;

wherein the valve is in contact with at least a portion of the valve supporting portion and with the annular portion, when sitting on the valve seat;

wherein the valve has a long plate shape, includes a fixed portion mounted on the compression mechanism unit, includes a distal end portion that is a free end, and is a reed valve that closes the valve seat when the distal end portion sits on the valve seat;

wherein the plurality of valve seat holes include:

a first valve seat hole formed closer, than a central spot of an opening of the annular portion, to the distal end portion, and a second valve seat hole formed closer, than the central spot of the opening of the annular portion, to the fixed portion; and wherein the first valve seat hole has an opening area larger than an opening area of the second valve seat hole.

15. A scroll compressor comprising:

a shell defining an outline of a sealed container;

a compression mechanism unit accommodated in the shell and defining a compression chamber in which refrigerant is compressed, the compression mechanism unit having a discharge port that is a through hole through which a discharge chamber surrounded by the shell and the compression mechanism unit and the compression chamber communicate with one another; and a discharge valve mechanism that is provided on a portion, of the compression mechanism unit, facing the discharge chamber and opens and closes the discharge port;

wherein the discharge valve mechanism includes:

a valve seat provided on an outlet portion of the discharge port that is an outlet-side opening end for refrigerant, and a valve that has a plate shape and closes the valve seat when sitting on the valve seat;

wherein the valve seat includes:

an annular portion serving as an edge of an opening of the outlet portion, and a valve supporting portion that is provided in a region surrounded by an inner circumference of the annular portion and divides the opening of the outlet portion into a plurality of valve seat holes that are through holes;

wherein the valve is in contact with at least a portion of the valve supporting portion and with the annular portion, when sitting on the valve seat; and wherein a discharge chamber-side surface of the valve supporting portion is provided closer to the compression chamber than a discharge chamber-side surface of the annular portion.

* * * * *